US007959523B2

(12) United States Patent
Rae et al.

(10) Patent No.: US 7,959,523 B2
(45) Date of Patent: Jun. 14, 2011

(54) GOLF CLUB HEAD HAVING A DISPLACED CROWN PORTION

(75) Inventors: John J Rae, Westminster, CA (US); Nathaniel J. Radcliffe, Hungtington Beach, CA (US); Daniel J. Stone, Long Beach, CA (US); Trent E. Garner, Champaign, IL (US); Brad S. Hooley, Huntington Beach, CA (US); Robert J. Horacek, Hermosa Beach, CA (US); Michael J. Wallans, Huntington Beach, CA (US)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 12/805,317

(22) Filed: Jul. 26, 2010

(65) Prior Publication Data

US 2010/0292029 A1 Nov. 18, 2010

Related U.S. Application Data

(63) Continuation of application No. 12/591,818, filed on Dec. 2, 2009, now Pat. No. 7,789,774, which is a continuation of application No. 11/247,148, filed on Oct. 12, 2005, now Pat. No. 7,651,414.

(60) Provisional application No. 60/617,659, filed on Oct. 13, 2004, provisional application No. 60/665,653, filed on Mar. 25, 2005.

(51) Int. Cl.
*A63B 53/04* (2006.01)

(52) U.S. Cl. ..... 473/345; 473/346

(58) Field of Classification Search ..... 473/324–350
See application file for complete search history.

(56) References Cited

U.S. PATENT DOCUMENTS 1,617,090 A 2/1927 Worthington
1,690,388 A 11/1928 Waldron
(Continued)

FOREIGN PATENT DOCUMENTS

JP 64-17667 1/1989
(Continued)

OTHER PUBLICATIONS

Wilson, Mark., Ed., "The Golf Club Identification & Price Guides III," Golfworks/Ralph Maltbies Enterprises, Inc., 1993, pp. 39-14, 39-27 and 39-33.

(Continued)

*Primary Examiner* — Alvin A Hunter
(74) *Attorney, Agent, or Firm* — Steptoe & Johnson LLP

(57) ABSTRACT

A hollow wood-type golf club head having an increased weight budget and improved mass characteristics at minimum structural mass is disclosed. The club head has a striking face portion, a sole portion, a skirt portion, and a crown portion having a total surface area. A hosel portion joins the club head for connecting a shaft to the club head. The crown portion has a major crown portion and a minor crown portion, the major portion having greater surface area than the minor portion, and the major portion being displaced vertically lower relative to the minor crown portion. The major crown portion may have a generally concave curvature and the minor crown portion may have a generally convex curvature such that the major crown portion is in effect inverted with respect to the minor crown portion. The major crown portion may be upwardly inclined from the heel to the toe of the head. The head may exhibit a parabolic top view silhouette.

18 Claims, 33 Drawing Sheets

U.S. PATENT DOCUMENTS

| | | | | |
|---|---|---|---|---|
| 2,056,335 | A | 10/1936 | Wettlaufer | |
| 2,213,190 | A | 9/1940 | Haverbach | |
| 2,550,846 | A | 5/1951 | Milligan | |
| 2,859,972 | A | 11/1958 | Reach | |
| D208,058 | S | 7/1967 | Johnston | |
| D239,187 | S | 3/1976 | Smith | |
| 4,214,754 | A | 7/1980 | Zebelean | |
| 4,431,192 | A | 2/1984 | Staff, Jr. | |
| 4,438,931 | A | 3/1984 | Motomiya | |
| 4,828,265 | A | 5/1989 | Antonius | |
| 4,900,029 | A | 2/1990 | Sinclair | |
| 4,930,783 | A | 6/1990 | Antonius | |
| 5,004,241 | A | 4/1991 | Antonius | |
| 5,141,230 | A | 8/1992 | Antonius | |
| 5,193,810 | A | 3/1993 | Antonius | |
| 5,221,086 | A | 6/1993 | Antonius | |
| 5,346,217 | A | 9/1994 | Tsuchiya et al. | |
| D351,442 | S | 10/1994 | Asabuki et al. | |
| D356,130 | S | 3/1995 | Schield | |
| D358,186 | S | 5/1995 | Mollison et al. | |
| 5,419,559 | A | 5/1995 | Melanson et al. | |
| 5,429,354 | A | 7/1995 | Long et al. | |
| D363,100 | S | 10/1995 | Long et al. | |
| D363,961 | S | 11/1995 | Krzynowek et al. | |
| D365,614 | S | 12/1995 | Su | |
| 5,482,279 | A | 1/1996 | Antonius | |
| 5,518,242 | A | 5/1996 | Mahaffey et al. | |
| 5,624,331 | A | 4/1997 | Lo et al. | |
| 5,718,641 | A | 2/1998 | Lin | |
| D406,295 | S | 3/1999 | Long | |
| D408,880 | S | 4/1999 | Crow | |
| 5,908,356 | A | 6/1999 | Nagamoto | |
| 5,941,782 | A | 8/1999 | Cook | |
| 5,944,620 | A | 8/1999 | Elmer | |
| D415,807 | S | 10/1999 | Werner et al. | |
| D418,885 | S | 1/2000 | Wanchena | |
| 6,012,989 | A | 1/2000 | Saksun, Sr. | |
| 6,017,280 | A | 1/2000 | Hubert | |
| 6,059,669 | A | 5/2000 | Pearce | |
| 6,139,446 | A | 10/2000 | Wanchena | |
| 6,247,636 | B1 | 6/2001 | Sun | |
| 6,248,026 | B1 | 6/2001 | Wanchena | |
| D447,201 | S | 8/2001 | Boyd | |
| D447,783 | S | 9/2001 | Glod | |
| 6,319,148 | B1 | 11/2001 | Tom | |
| 6,332,848 | B1 | 12/2001 | Long et al. | |
| 6,354,963 | B1 * | 3/2002 | Kodama et al. | 473/345 |
| D463,516 | S | 9/2002 | Antonius | |
| 6,471,604 | B2 | 10/2002 | Hockness et al. | |
| D470,552 | S | 2/2003 | Cleveland et al. | |
| D470,553 | S | 2/2003 | Helmstetter et al. | |
| 6,530,847 | B1 | 3/2003 | Antonius | |
| 6,530,848 | B2 | 3/2003 | Gillig | |
| 6,558,273 | B2 | 5/2003 | Kobayashi et al. | |
| 6,575,845 | B2 | 6/2003 | Galloway et al. | |
| 6,582,323 | B2 | 6/2003 | Soracco et al. | |
| 6,623,374 | B1 | 9/2003 | Helmstetter et al. | |
| 6,623,378 | B2 | 9/2003 | Beach et al. | |
| D484,937 | S | 1/2004 | Madore et al. | |
| 6,676,536 | B1 | 1/2004 | Jacobson | |
| D491,992 | S | 6/2004 | Baiocchi | |
| 6,832,961 | B2 | 12/2004 | Sano | |
| 6,855,068 | B2 | 2/2005 | Antonius | |
| 6,872,152 | B2 | 3/2005 | Beach et al. | |
| 6,875,126 | B2 | 4/2005 | Yabu | |
| 7,056,228 | B2 | 6/2006 | Beach et al. | |
| 7,258,626 | B2 * | 8/2007 | Gibbs et al. | 473/329 |
| 7,371,191 | B2 * | 5/2008 | Sugimoto | 473/345 |
| 7,435,190 | B2 * | 10/2008 | Sugimoto | 473/345 |
| 7,445,564 | B2 | 11/2008 | Kusumoto | |
| 7,470,200 | B2 | 12/2008 | Sanchez | |
| 2001/0049310 | A1 | 12/2001 | Cheng et al. | |
| 2003/0032500 | A1 | 2/2003 | Nakahara et al. | |
| 2003/0083151 | A1 | 5/2003 | Nakahara et al. | |
| 2003/0100381 | A1 | 5/2003 | Murphy et al. | |
| 2003/0125127 | A1 | 7/2003 | Nakahara et al. | |
| 2003/0134693 | A1 | 7/2003 | Nakahara et al. | |
| 2003/0144074 | A1 | 7/2003 | Gillig | |
| 2003/0153401 | A1 | 8/2003 | Helmstetter et al. | |
| 2003/0171160 | A1 | 9/2003 | Murphy et al. | |
| 2003/0176238 | A1 | 9/2003 | Galloway et al. | |
| 2003/0207727 | A1 | 11/2003 | Kakiuchi | |
| 2003/0228931 | A1 | 12/2003 | Antonius | |
| 2004/0116208 | A1 | 6/2004 | DeShiell et al. | |
| 2004/0176181 | A1 | 9/2004 | Meyer et al. | |
| 2004/0192468 | A1 | 9/2004 | Onada et al. | |
| 2004/0254030 | A1 | 12/2004 | Nishitani et al. | |
| 2005/0009622 | A1 | 1/2005 | Antonius | |
| 2005/0221913 | A1 | 10/2005 | Kusumoto | |

FOREIGN PATENT DOCUMENTS

| | | |
|---|---|---|
| JP | 64-17668 | 1/1989 |
| JP | 10-085369 | 4/1998 |
| JP | 11-19253 | 1/1999 |
| JP | 11-019253 | 1/1999 |
| JP | D1083370 | 8/2000 |

OTHER PUBLICATIONS

"Nicklaus Golf Equipment 1998 Product Catalogue," Air Bear 2 Woods section.

Vulcan Golf LUV golf clubs, info and specs found at: http://www.vulcangolf.com/irons/luv54/luv54.asp.

Vulcan GolfZ3+ golf clubs, info and specs found at: http://www.vulcangolf.com/z3plus/default.asp.

Maltby Xstreamliner golf club, info and specs found at: http://www.bobsgolf.co.uk/index.html?target=p_344.html&lang=en-gb.

Golf Equipment Universal Catalogue 1993, MacGregor "T.T. MAC," p. 324.

Golf Equipment Universal Catalogue 1993, RYOBI "UNIFIX 970G II," p. 515.

Golf Equipment Universal Catalogue 1993, "PELES," p. 645.

Golf Equipment Universal Catalogue 1995, PRO-GO "BRITE 3," p. 296.

Golf Equipment Universal Catalogue 1996, Spalding, "Top-Flite Magna Topless," p. 150.

Golf Equipment Universal Catalogue 1998, ENA "Magic Wand" and "Magic Wand VIP," p. 358.

Golf Equipment Universal Catalogue 1999, "Kailas Geotech," p. 589.

Golf Equipment Universal Catalogue 1999, "Guwn CTM-08," p. 387.

Golf Equipment Universal Catalogue 2000, MacGregor "MACEASY EZOn Fw" and "MACEASY EZOn Wi," p. 162.

Cleveland Golf, Launcher 330 Driver, Aug. 2002.

Cleveland Golf, Launcher 400 Driver, Aug. 2002.

Cleveland Golf, Launcher 460 Driver, Jan. 2004.

* cited by examiner

GOLF CLUB HEAD HAVING A DISPLACED CROWN PORTION

CROSS REFERENCE TO RELATED APPLICATIONS

This application claims the benefit of U.S. Provisional Applications Nos. 60/617,659 and 60/665,653 which are hereby incorporated by reference in their entireties.

BACKGROUND

This invention pertains generally to improved metal wood type golf club heads and more particularly to a golf club head having an improved crown configuration incorporating high specific-strength materials. A recent trend in golf club head design has been to increase the size of such heads to generate increased performance and create more "forgiving" golf clubs. Although this can be said to be true for golf clubs in general, it may be observed that wood type club heads in particular have increased in size dramatically over the past few years. This has presented a number of challenges to designers of modern "metal wood" golf clubs.

Traditional wood type golf club heads generally comprise four primary surfaces that form a solid with predominantly convex outer surfaces. These four primary surfaces are referred to as the striking face (front surface), crown (top surface), skirt (side surface), and sole (bottom surface). In the case of modern metal woods, these surfaces form the exterior of thin metallic walls that are joined or integrally formed to create a thin-walled solid structure. A hosel is typically attached to at least one of the primary surfaces, and serves as a coupling member for attachment of a shaft to the club head. Such metal woods have nominal mass properties including a target mass, a center of gravity, and moments of inertia about a set of axes originating from a reference location (typically the center of gravity, or a point along the hosel axis).

The target mass refers to the ideal total mass for a finished club head, and must be differentiated from a minimum structural mass of a club head. Each club head must have a finished mass that yields a minimum desired swingweight value when assembled to a shaft fitted with a grip. The target mass will depend on the expected maximum length of shaft that may be assembled to the head, and taking into consideration the selection of grips that may be fitted thereto. The swingweight value may then be increased throughout a desired range of values for that shaft length, preferably by adding minor amounts of ballast. For shafts of lesser lengths, the minimum swingweight, and subsequently larger swingweights, may also be achieved by adding more ballast. Therefore the target mass of the head is dictated by the club type, shaft materials and maximum length, as well as the selection of grips which may be fitted thereto.

The minimum structural mass of a club head refers to the minimum mass of all structural components required to produce a club head having a desired shape and geometry that can withstand the loads experienced during normal use. If the minimum structural mass achieved for a given design is less than the target mass, the difference is known as discretionary mass. This amount of discretionary mass may be strategically positioned throughout the club head to fine tune its performance characteristics. Parameters such as center of gravity location, principal axes and the magnitudes of the moments of inertia about them, may all be manipulated through strategic placement of discretionary mass. Thus, it is highly desirable for a club head design to achieve the absolute minimum structural mass to maximize the amount of discretionary mass available to the designer. This amount of discretionary mass available to the designer is also known as the weight budget.

It is known that a low and deep center of gravity generally provides beneficial launch conditions at the moment of impact between a golf club head and ball. Specifically, the combination of a high launch angle and a low ball spinning speed provides increased carry and therefore greater overall distance. Displacing the center of gravity lower in the head (closer to the sole) yields a higher launch angle to the ball at impact, accompanied by increased back spin. Positioning the center of gravity deeper in the club head (farther rearward from the face) will reduce the amount of back spin imparted to the ball at impact. Therefore, for optimum launch conditions of a metal wood, a low and deep club head center of gravity is sought.

A recent trend in metal wood design has been to increase head size in an effort to maximize moments of inertia, thereby minimizing distance loss when a ball is struck other than in the sweet spot of the striking face. However, increased head sizes have generated metal woods with commensurately larger and taller striking faces, which in turn increases the vertical distance between the crown and sole walls. Skirt walls have become correspondingly taller to bridge the larger distances between crown and sole. Therefore, at the minimum structural mass, center of gravity heights have increased in modern club heads.

Further, since the striking face must withstand the greatest loads compared to a remainder of the club head under normal use, it is generally the thickest wall of a metal wood head, and therefore the heaviest. Thus, increases in striking face size have also displaced center of gravity positions farther forward within modern metal wood heads at their minimum structural mass.

Still further, increasing the overall size of modern metal wood club heads has been accompanied by an increase in the volume of material required to form the head, therefore increasing the minimum structural mass, whereas target masses have remained constant. Increasing head volume while maintaining traditional head shapes has therefore resulted in decreased weight budget and a correspondingly reduced ability to improve the mass properties of modern metal wood club heads.

Recent attempts to mitigate increased structural mass have included the advancement of thin-walled casting techniques for metal wood head portions such as the crown, sole, or skirt that may previously have had thicknesses that were greater than necessary for the structural loads placed on them during use. The result has been the achievement of the thinnest possible casting thicknesses for such portions with significant gains in weight budget and therefore the ability to better define the mass properties of metal wood heads. However, it has been demonstrated that there is room for further improvement upon these results, and that it is possible to produce metal wood heads with still more superior performance.

Accordingly, club head manufacturers have advanced club performance by fabricating select head portions from materials having a specific strength (ultimate tensile strength divided by specific gravity) that is greater than conventional head materials such as steel or titanium, while fabricating the rest of the head using conventional metal wood techniques and materials. These types of club heads are generally expensive to manufacture. The head portions are typically attached using various techniques, for example bonding. They can experience reduced durability, and produce a less satisfying sound at impact than a hollow metal wood of advanced thin-wall construction. The sound produced by any golf club at impact has a great deal of influence on a golfer's perception of the quality and performance of the club as a whole, and golfers are particularly demanding of a quality sound produced at impact by metal wood clubs.

Alternative attempts to achieve a minimum structural mass and hence increased weight budget over conventional metal wood head configurations have included the use of composite materials to form the head, e.g. carbon fiber reinforced epoxy or carbon fiber reinforced polymer, in place of traditional materials such as aluminum, steel, and titanium. A primary benefit of using composite materials to construct a head is their improved strength to weight ratios in comparison to traditional materials, permitting a reduction in the head's minimum structural mass, thereby increasing the weight budget available for strategic placement. However, such heads have suffered from durability, performance, and manufacturing issues associated with composite materials. These include higher labor costs in manufacture, undesirable acoustic properties, shearing and separation of composite plies used to form the striking surface of the club head, and comparatively low coefficients of restitution.

In such heads made from composite materials, the areas subject to greatest wear, e.g. the face and sole, have been provided with a metal plate in one or both regions in an attempt at reinforcing those regions. Integrated metal face and hosel constructions have also been attempted with the remainder being formed of composite material, and in several instances such constructions have also included a metal skirt portion. These hybrid constructions have remedied many of the durability issues associated with heads formed entirely of composites while retaining some of the weight budget increase afforded by replacing metal components with a composite material. Furthermore, when a metal is used for the striking face, coefficients of restitution generally similar to those of wood type heads having all-metal construction have been achieved. However, such hybrid constructions are still bound by the inherent disadvantages of a traditional metal wood head shape, including the substantial mass of the crown and skirt portions being concentrated high within the head.

Still other attempts at improving club performance have included the elimination of certain portions of the club head as a whole, most notably the crown, in an attempt to eliminate the contribution of that component's mass from the overall head weight and thereby lower the center of gravity. Such club heads require a great deal of reinforcement in other areas of the head to compensate for the reduced structural integrity due to an open section, which virtually eliminates the possibility of achieving an increased weight budget. Further, such heads have also produced a displeasing sound at impact.

Additionally, club heads which are combinations of the above themes have been manufactured. Such combinations have included club heads where a portion, such as the crown, has been eliminated and certain components, for example the face, have been fabricated from higher specific strength materials. Such variations have yielded disadvantages consistent with the designs mentioned above.

Hence, there exists a need in the art of golf club design for improved metal wood head configurations that provide an improved center of gravity location at the minimum structural mass, and an increased weight budget. In addition, there exists a further need for an additional improvement including use of hybrid material construction, thereby advancing the performance standard of club heads of the metal wood variety to a level not previously attained in the industry.

SUMMARY OF THE INVENTION

The present invention comprises a novel hollow metal wood golf club head having an increased weight budget and improved mass characteristics at minimum structural mass. In one embodiment of the invention the club head includes a striking face portion, a sole portion, a skirt portion, and a crown portion having a total surface area. A hosel portion joins the club head for connecting a shaft to the club head. The crown portion comprises a major crown portion and a minor crown portion, the major portion having greater surface area than the minor portion, and the major portion being displaced vertically lower relative to the minor portion.

The major crown portion may have a generally concave curvature and the minor crown portion may have a generally convex curvature.

These and other features, aspects, and advantages of the club head in its various embodiments will become apparent after consideration of the ensuing description, the accompanying drawings, and the appended claims.

BRIEF DESCRIPTION OF THE DRAWINGS

Embodiments of the present invention will now be described, by way of example only, with reference to the following drawings in which:

FIG. 7(*b*) is a rear cross-sectional view of the club head of FIG. 1 with the section taken along the line VII(b)-VII(b) of FIG. 7(*a*);

FIG. 8(*b*) is a cross-sectional view from the toe of the club head of FIG. 1 with the section taken along the line VIII(b)-VIII(b) of FIG. 8(*a*);

FIG. 9(*b*) is a transverse cross-sectional area VIII(a)-VIII (a) of the club head of FIG. 1;

FIG. 14(*b*) is a perspective view of yet another embodiment of a head like that shown in FIG. 1;

FIG. 15(*b*) is a perspective view of a yet further embodiment of a head like that shown in FIG. 1;

FIG. 16(*b*) is a rear perspective view of the head shown in FIG. 15(*b*);

FIG. 17(*b*) is a perspective view of yet another further embodiment of a head like that shown in FIG. 1;

FIG. 18(*b*) is a cross-sectional view of a second exemplary bonded joint type for joining two thin sheets;

FIG. 18(*c*) is a cross-sectional view of a third exemplary bonded joint type for joining two thin sheets;

FIG. 18(*d*) is a cross-sectional view of a fourth exemplary bonded joint type for joining two thin sheets;

FIG. 18(*e*) is a cross-sectional view of a fifth exemplary bonded joint type for joining two thin sheets;

FIG. 19(*b*) is a cross-sectional view of a further variation of the fourth exemplary joint configuration as adapted to the head of FIG. 13, where the section is taken at line XIX-XIX;

FIG. 19(*c*) is a cross-sectional view of another further variation of the fourth exemplary joint configuration as adapted to the head of FIG. 13, where the section is taken at line XIX-XIX;

FIG. 19(*d*) is a cross-sectional view of yet another further variation of the fourth exemplary joint configuration as adapted to the head of FIG. 13, where the section is taken at line XIX-XIX;

FIG. 20(*b*) is an enlarged sectional view showing more detail of the exemplary joint configuration shown in FIG. 18(*e*);

FIG. 20(*c*) is an enlarged sectional view showing a variation of the exemplary joint configuration shown in FIG. 20(*b*);

FIG. 27(*b*) is a further cross-sectional view of an exemplary head in accordance with the present invention, showing internal features;

FIG. 27(*c*) is yet another further cross-sectional view of an exemplary head in accordance with the present invention, showing internal features; and FIG. 27(*d*) is still another further cross-sectional view of an exemplary head in accordance with the present invention, showing internal features.

For purposes of illustration these figures are not necessarily drawn to scale. In all of the figures, like components are designated by like reference numerals.

DETAILED DESCRIPTION OF THE PREFERRED EMBODIMENTS

Throughout the following description, specific details are stated in order to provide a more thorough understanding of the invention. However, the invention may be practiced without these particulars. In other instances, well known elements have not been shown or described to avoid unnecessarily obscuring the invention. Accordingly, the detailed description and drawings are to be regarded in an illustrative rather than a restrictive sense.

Figure 1:
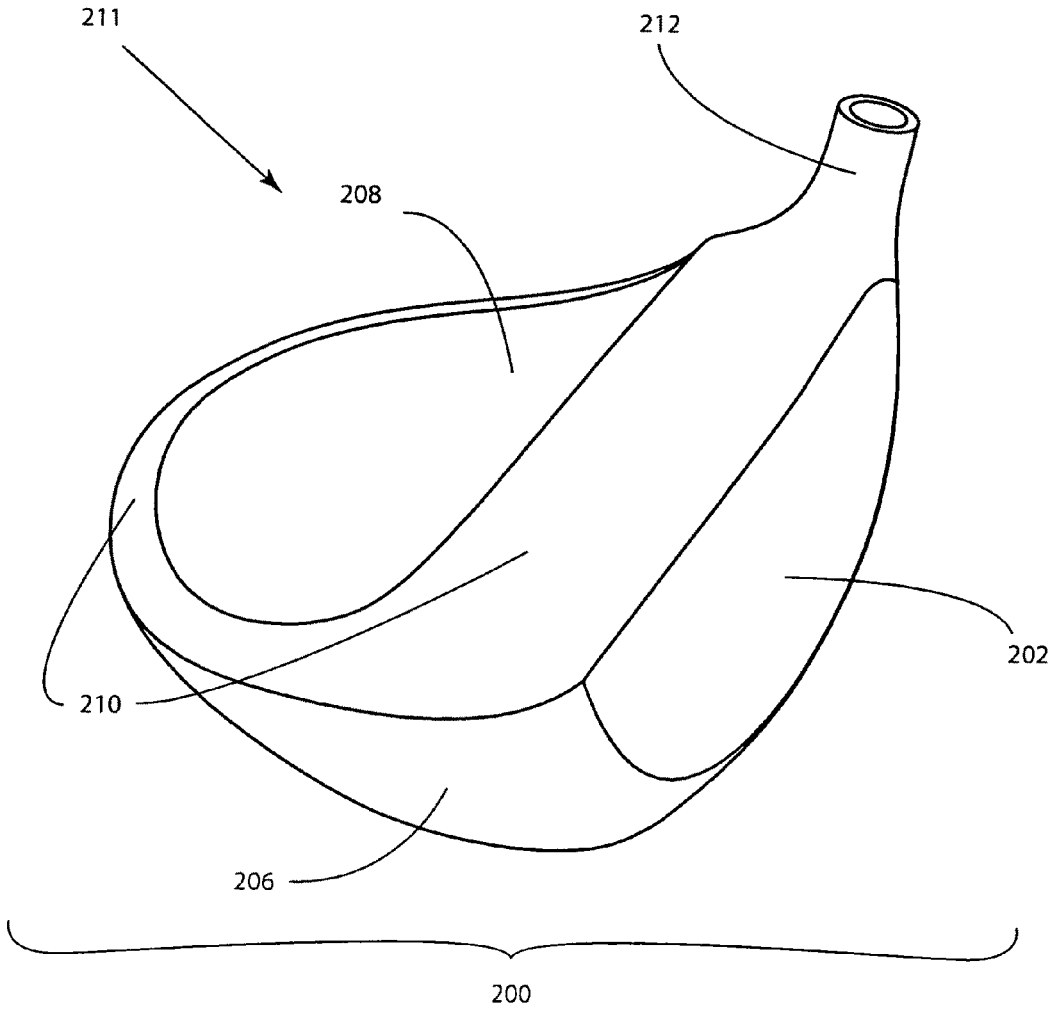
FIG. 1 is a perspective view of an embodiment of a club head in accordance with the present invention.
Figure 3:
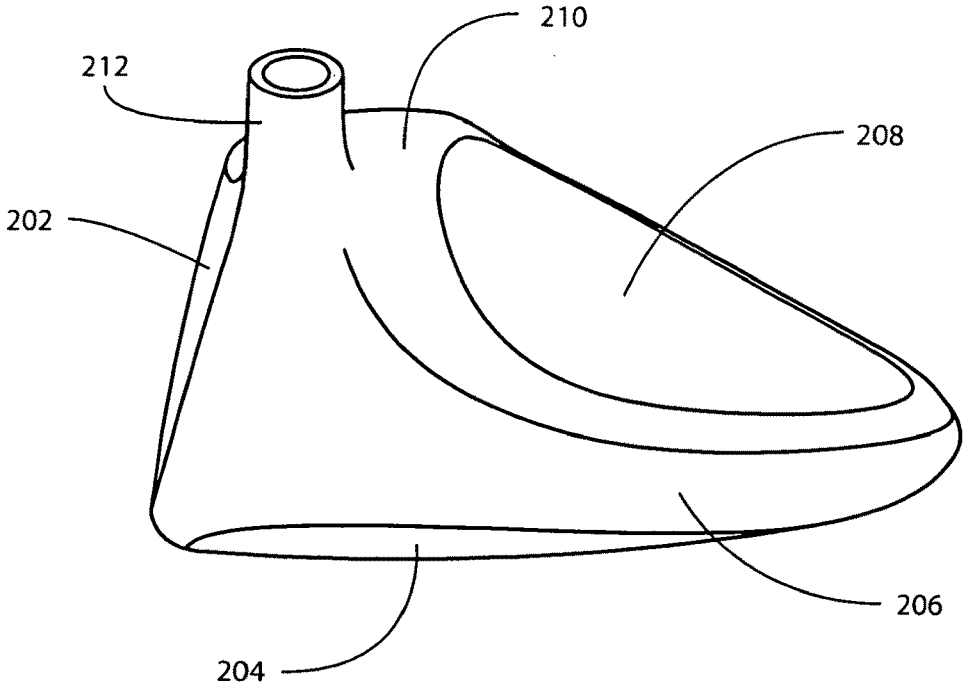
FIG. 3 is a heel view of the club head of FIG. 1.
Figure 4:
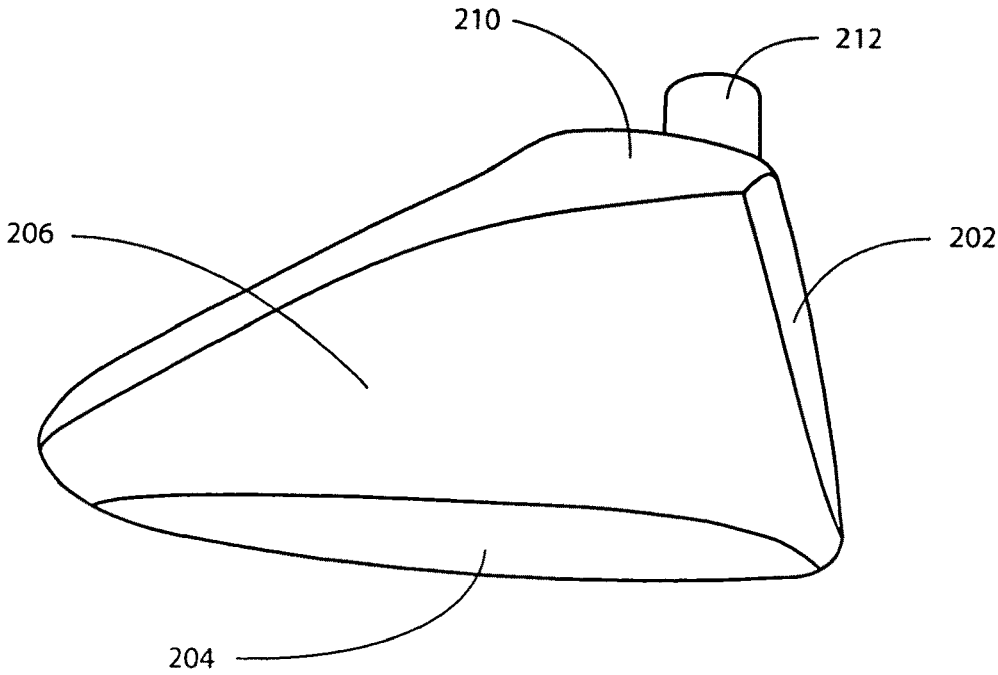
FIG. 4 is a toe view of the club head of FIG. 1.
Figure 5:
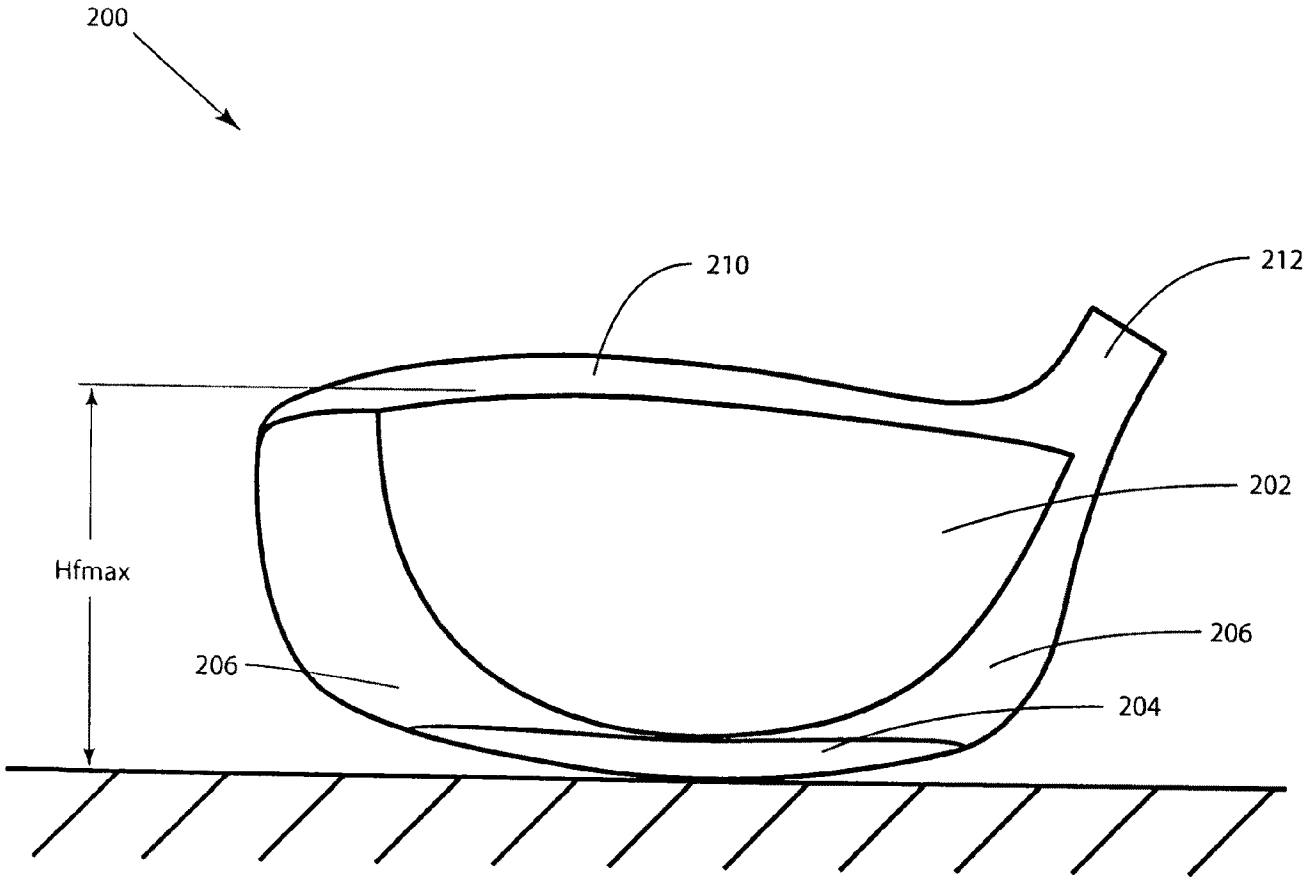
FIG. 5 is a front or face view of the club head of FIG. 1.

A golf club head 200 is shown in FIG. 1 depicting an exemplary embodiment of the present invention. The head has five primary surfaces, each defining a portion of the club head 200, namely, a front surface defining a striking face portion 202, a bottom surface defining a sole portion 204 (see FIGS. 3 and 4), a side surface defining a skirt portion 206, a first top surface defining a major crown portion 208, and a second top surface defining a minor crown portion 210. Major crown portion 208 and minor crown portion 210 together form crown 211. A hosel 212 is provided for receiving a shaft (not shown).

Figure 2:
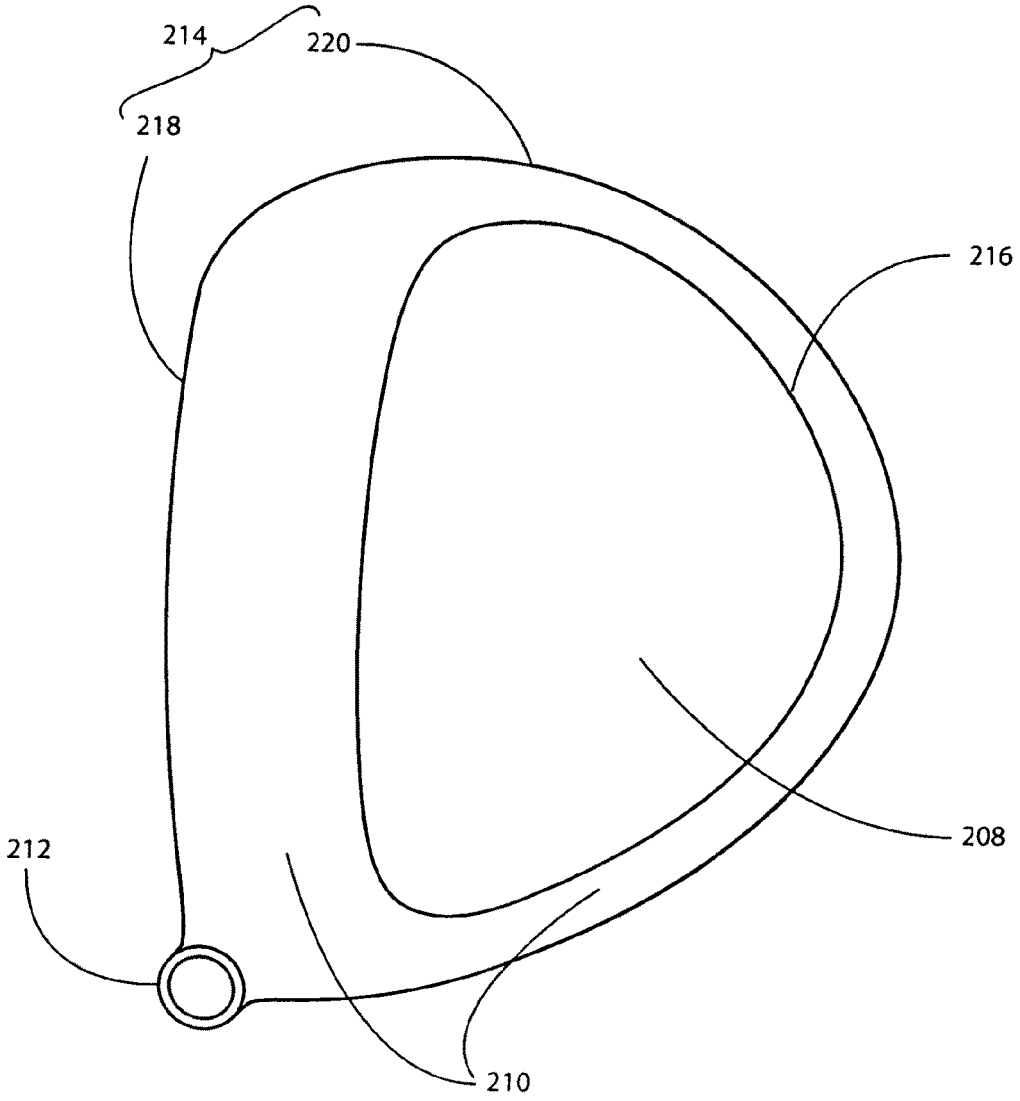
FIG. 2 is a view taken from the top and parallel to the face of the club head of FIG. 1.

Striking face portion 202 has a loft angle, which defines the angle striking face portion 202 forms relative to vertical when head 200 is resting in an address position. The extremities of crown 211 may be determined by viewing the club head from a top-down direction in a plane that is generally parallel to the face, as illustrated in FIG. 2. The perimeter of the shape visible in this perspective, and represented by a crown perimeter edge 214, generally demarcates crown 211 from striking face portion 202 and skirt portion 206, both of which are not visible from this perspective. Crown perimeter edge 214 may comprise a top-line edge 218 that delimits crown 211 from face portion 202 and a tail edge 220 that delimits crown 211 from skirt portion 206. Minor crown portion 210 may have a surface contour generally consistent with contemporary metal wood crowns, and may be generally delimited from major crown portion 208 by a major crown portion perimeter edge 216. Either or both of edges 214 and 216 may not necessarily be represented by sharp or linear edges, but may be embodied as radiused or contoured transitions between the respective portions. In such instances, the line that passes through the approximate apex(es) along the radiused surface that joins the portions may be substituted for either or both of edges 214 and 216.

Major crown portion 208 may be generally characterized as being displaced vertically lower than a corresponding adjacent portion of minor crown portion 210. Major crown portion 208 may be further characterized as having a surface contour that does not follow the surface contour of minor crown portion 210, whereby the bulk of major crown portion 208 is displaced vertically downward relative to corresponding adjacent portions of minor crown portion 210. As seen for example in FIG. 4, when viewed from the toe of the club head 200, the major crown portion 208 is not visible because the surface contour thereof is inverted with respect to the surface contour of minor crown portion 210. In one embodiment of the invention, major crown portion 208 may be characterized further still as having a concave surface contour while minor crown portion 210 may be characterized as having a generally convex curvature, whereby the bulk of major crown portion 208 is displaced vertically downward relative to adjacent portions of minor crown portion 210. Thus, head 200 may maintain similar or even identical sole and striking face proportions to that of modern metal wood heads with a reduction in volume of about 15 to about 40 percent, depending on the surface contour selected for major crown portion 208. Further, an appreciable amount of minimum structural mass of club head 200 is relocated vertically lower, which improves the mass characteristics of head 200 and allows for an improved center of gravity position and therefore improves launch characteristics. Additionally, there is a significant reduction in the amount of material required to form skirt 206. This reduction in material mass equates to a corresponding increase in the weight budget for head 200.

Major crown portion 208 may comprise anywhere from about 51 to about 90 percent of the surface area of crown 211. Major crown portion 208 is entirely visible from a golfer's perspective when head 200 is attached to a shaft to form a club and the club is held at an address position by the golfer.

Figure 6:
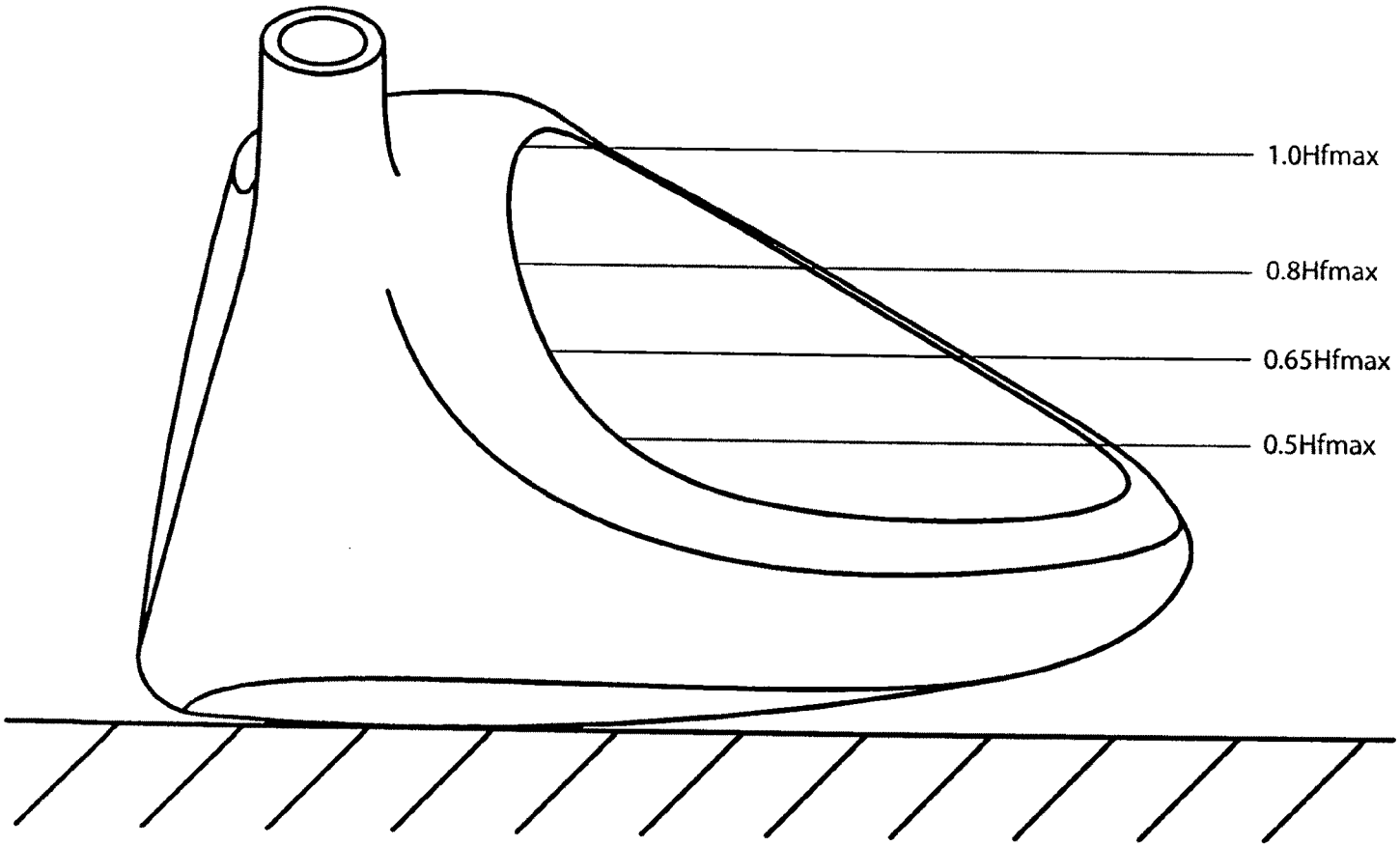
FIG. 6 is a heel view of the club head of FIG. 1 depicting horizontal datum plane positions relative to a maximum face height.

As illustrated in FIG. 6, the vertical position of major crown portion 208 may be related to the face height of club head 200, whereby certain percentages of the major crown portion's total surface area reside below corresponding threshold ratios of the maximum face height, $Hf_{max}$. For example, in general about 95% or more of major crown portion 208 may reside below a height of $Hf_{max}$, about 80% or more may reside below a height of 0.80 $Hf_{max}$, about 60% or more may reside below a height of 0.65 $Hf_{max}$, and about 30% or more may reside below a height of 0.50 $Hf_{max}$. In a more extreme configuration, it may be expected that about 98% or more of major crown portion 208 may reside below a height of $Hf_{max}$, about 85% or more may reside below a height of 0.80 $Hf_{max}$, about 70% or more may reside below a height of 0.65 $Hf_{max}$, about 50% or more may reside below a height of 0.50 $Hf_{max}$, and about 25% or more may reside below a height of 0.35 $Hf_{max}$. The above percentages may be computed with club head 200 in the address position, with horizontal datum planes intersecting the head at the designated vertical positions relative the maximum face height, $Hf_{max}$. The surface area of major crown portion 208 lying below the respective horizontal datum planes may then be measured and compared against the total surface area of major crown portion 208 and the resulting percentage calculated.

Since the distribution of surface area of major crown portion 208 requires that the surface shape of crown 211 is a departure from one that golfers may be accustomed to, it may be beneficial to shape major crown portion 208 to minimize distraction of the user's attention. A conventional club silhouette at address is advantageous due to negative effects a more radical club head appearance may have on the mental performance of certain golfers. For such golfers, a departure from traditional head shapes may unduly distract their attention or render it difficult to frame the ball at address, and may therefore adversely affect their ability to strike the ball well. A conventional club head silhouette is generally characterized by crown perimeter edge 214 defining a slightly convex topline edge 218 and a generally parabolic tail edge 220, as shown in FIG. 2.

Figure 7:
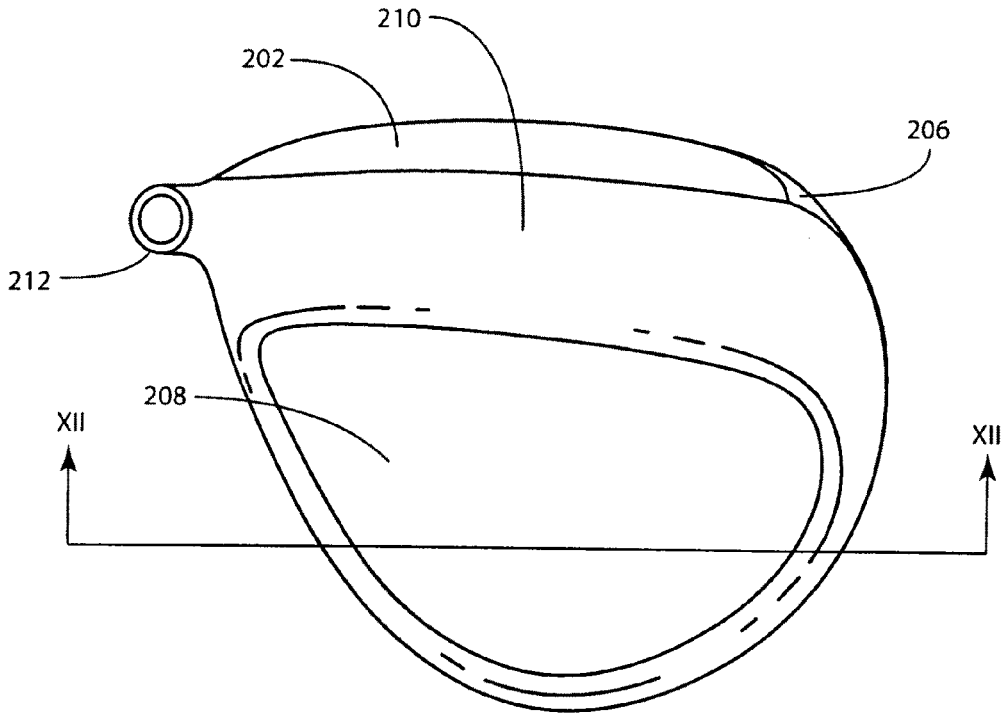
FIG. 7(*a*) is a top view of the club head of FIG. 1 showing the location VII(b)-VII(b) of a transverse cross section.
Figure 7:
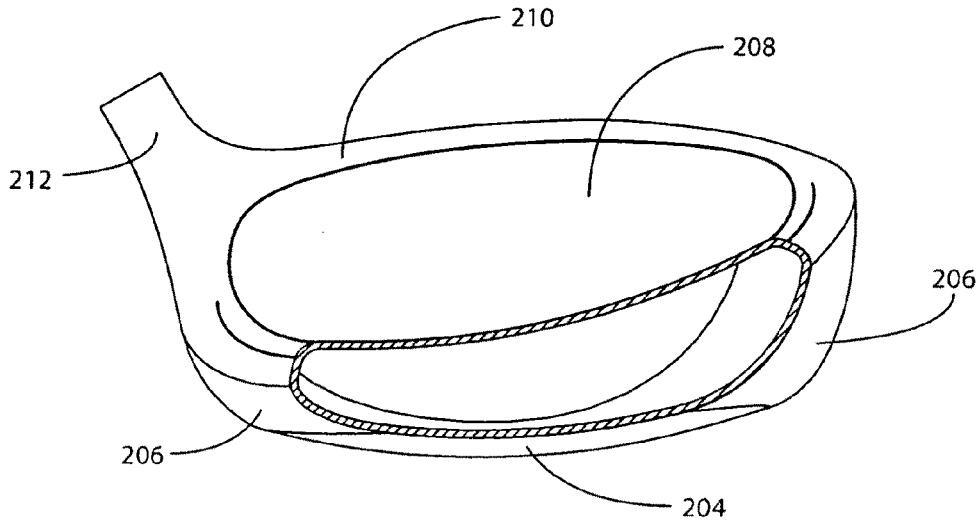
Figure 8:
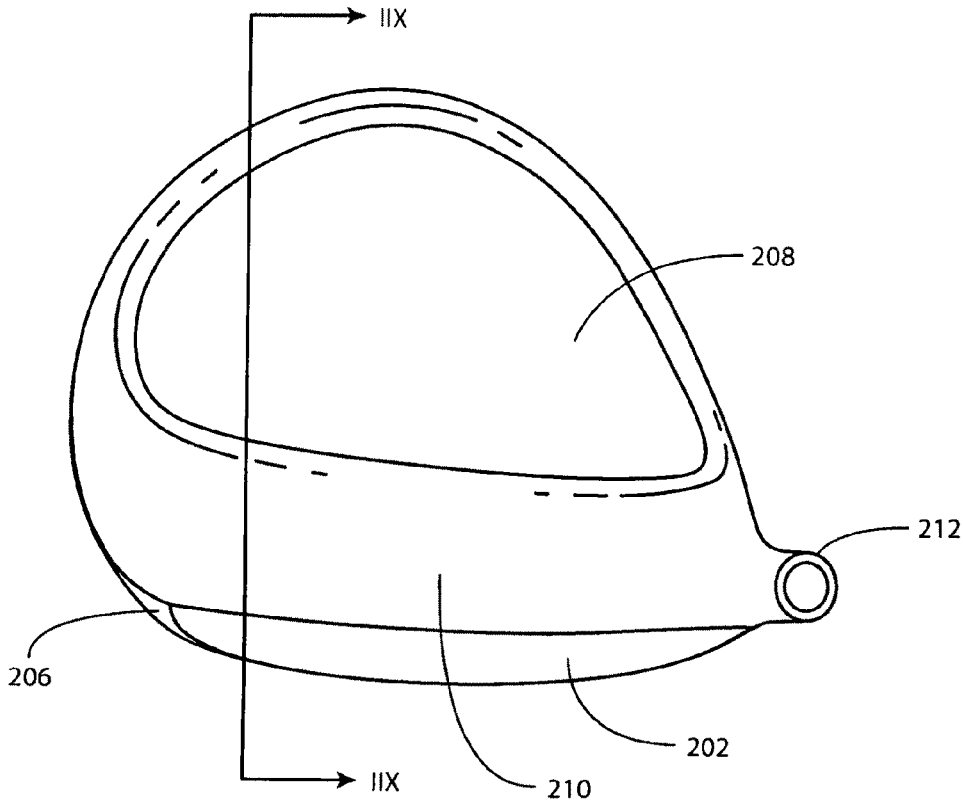
FIG. 8(*a*) is a further top view of the club head of FIG. 1 showing the location VIII(a)-VIII(a) of a longitudinal cross section.
Figure 8:
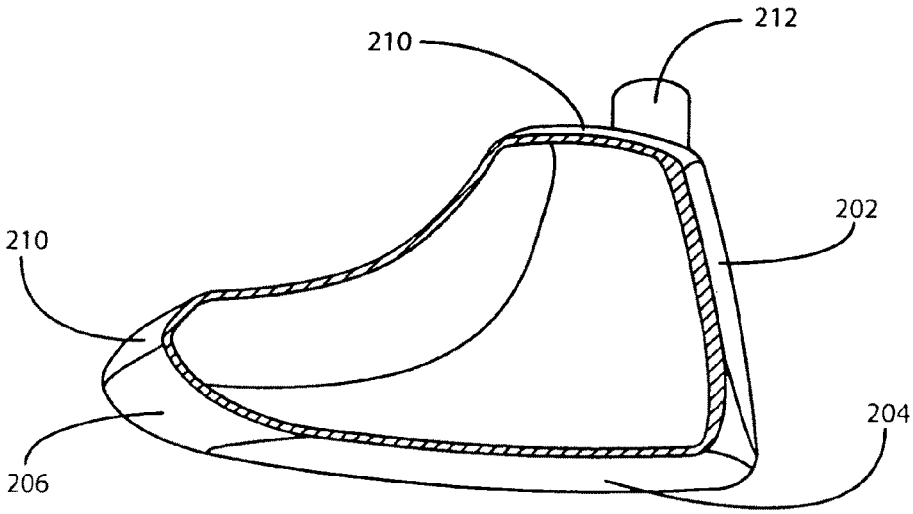

The surface shape of major crown portion 208 may be conveniently described in two directions; transverse and longitudinal. The longitudinal direction refers to the front-to-back and/or back-to-front directions of club head 200, whereas the transverse direction refers to the heel-to-toe and/or toe-to-heel directions of club head 200. The transverse direction is therefore perpendicular to the longitudinal direction, and vice-versa. FIGS. 7(*b*) and 8(*b*) illustrate exemplary sections taken in the longitudinal and transverse directions of FIGS. 7(*a*) and 8(*a*), respectively.

Figure 9:
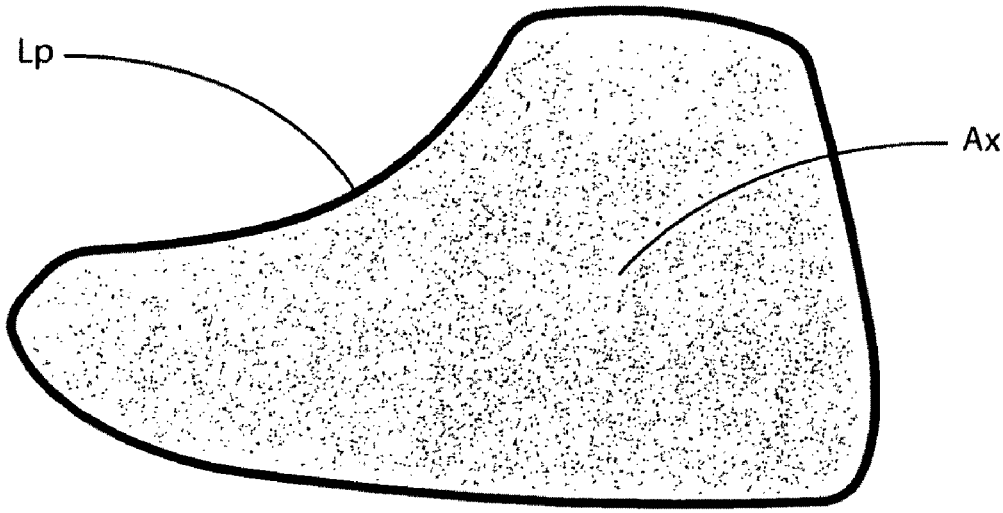
FIG. 9(*a*) is a longitudinal cross-sectional area at plane VIII(b)-VIII(b) of the club head of FIG. 1.
Figure 9:
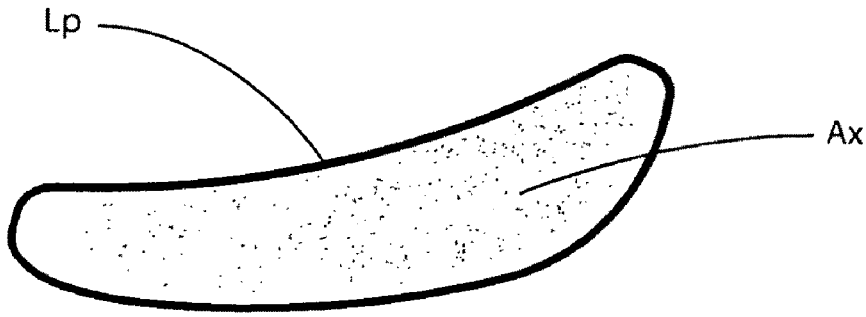
Figure 10:
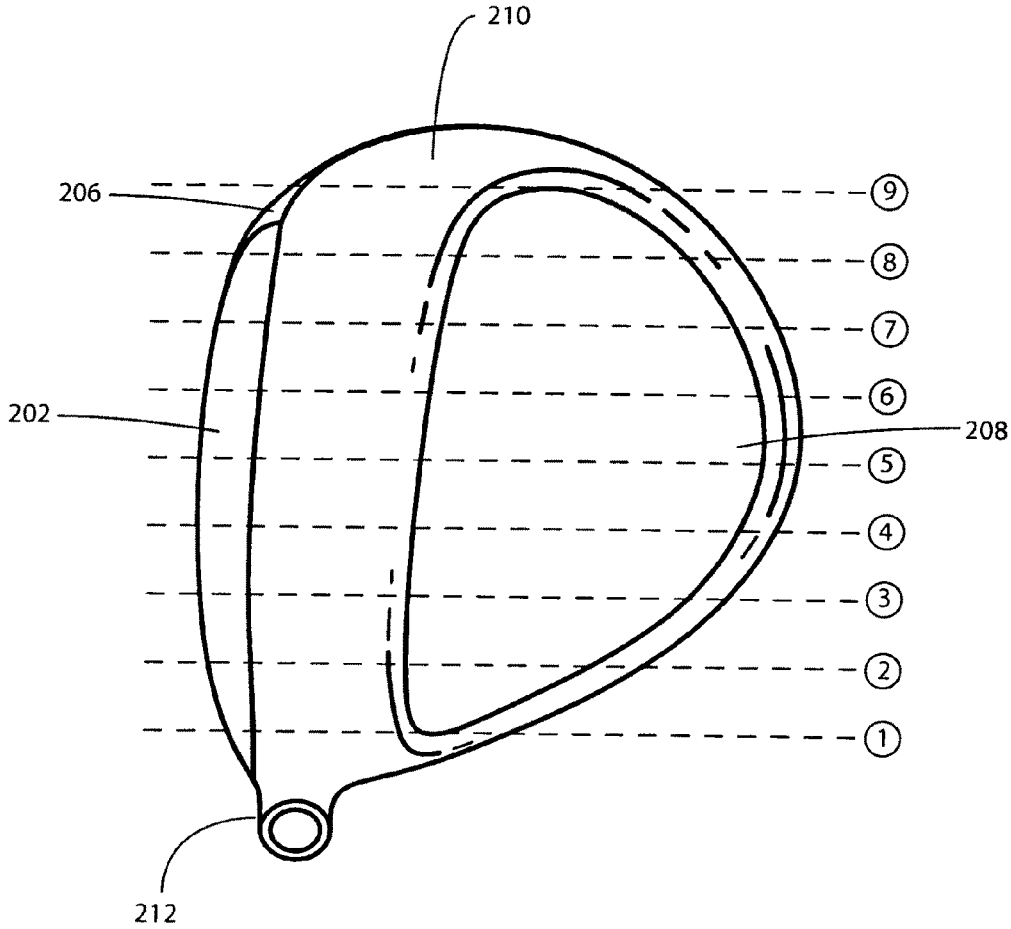
FIG. 10 is a further top view of the club head of FIG. 1 depicting the locations of longitudinal cross-sections used in the analysis of said club head.

Achieving a well-balanced surface contour for major crown portion 208 involves a consideration of major crown portion 208 on its own, and also the interaction of the contour with the shape and proportions of head 200 as a whole. It is therefore useful to express the contour of major crown portion 208 as a function of the entire head geometry. Since head 200 maintains the shape and proportions of a conventional metal wood, with the exception of its distinct crown configuration, an analysis was performed which is descriptive of the unique topography of major crown portion 208. A set of longitudinal co-planar cross-sections, a single example of which is shown in FIG. 9(*a*), was taken from an exemplary embodiment of club head 200. Each section has a perimeter length, $L_p$, and a cross-sectional area, $A_x$ (shown as shaded), whose values are presented in Table 1, below. For comparison, Table 1 also includes values corresponding to a conventionally shaped club head of commensurately greater volumetric displacement, but similar to identical proportions and dimensions in all portions except the crown. Each section was incrementally taken across the transverse span of major crown portion 208, as shown in FIG. 10. The distance at which each section was taken was referenced to the heel-most extremity of exemplary head 200, and each corresponding section of the exemplary conventional metal wood head was taken at the same transverse position. The position at which each section was taken is represented in FIG. 10 by a unique section denoted by a numeral, and each numeral corresponds to the section number assigned in Table 1.

Since a majority of the crown 211 of club head 200 is displaced vertically lower than in a conventional wood head, the cross-sectional areas taken from head 200 are significantly reduced, whereas the perimeter lengths of the sections are generally increased a slight amount. Thus, the $L_p/A_x$ ratios across the major crown portion's transverse span are significantly increased versus those taken from a corresponding span of a conventional metal wood head's crown portion. The ratios of $L_p/A_x$ in the transverse direction therefore distinguish head 200 from typical metal wood heads, and analyzing their change along the transverse direction is a useful way to quantitatively describe contour variation in relation to the entire head shape of major crown portion 208.

TABLE 1

| | | Exemplary Embodiment | | | Conventional Metal Wood Head | | |
|---|---|---|---|---|---|---|---|
| Section | Transverse Distance | $L_p$ (cm) | $A_x$ (cm$^2$) | $L_p/A_x$ | $L_p$ (cm) | $A_x$ (cm$^2$) | $L_p/A_x$ |
| 1 | 0.4 | 19.39 | 21.63 | 0.90 | 19.33 | 26.48 | 0.73 |
| 2 | 0.8 | 23.03 | 27.33 | 0.84 | 22.88 | 36.22 | 0.63 |
| 3 | 1.2 | 25.48 | 32.03 | 0.80 | 25.24 | 43.48 | 0.58 |
| 4 | 1.6 | 26.91 | 35.50 | 0.76 | 26.62 | 47.99 | 0.55 |
| 5 | 2.0 | 27.44 | 37.57 | 0.73 | 27.22 | 50.09 | 0.54 |
| 6 | 2.4 | 27.19 | 38.16 | 0.71 | 27.10 | 49.75 | 0.54 |
| 7 | 2.8 | 26.20 | 37.25 | 0.70 | 26.23 | 46.81 | 0.56 |
| 8 | 3.2 | 24.43 | 34.81 | 0.70 | 24.44 | 41.21 | 0.59 |
| 9 | 3.6 | 21.54 | 30.03 | 0.72 | 21.37 | 32.58 | 0.66 |

Figure 11:
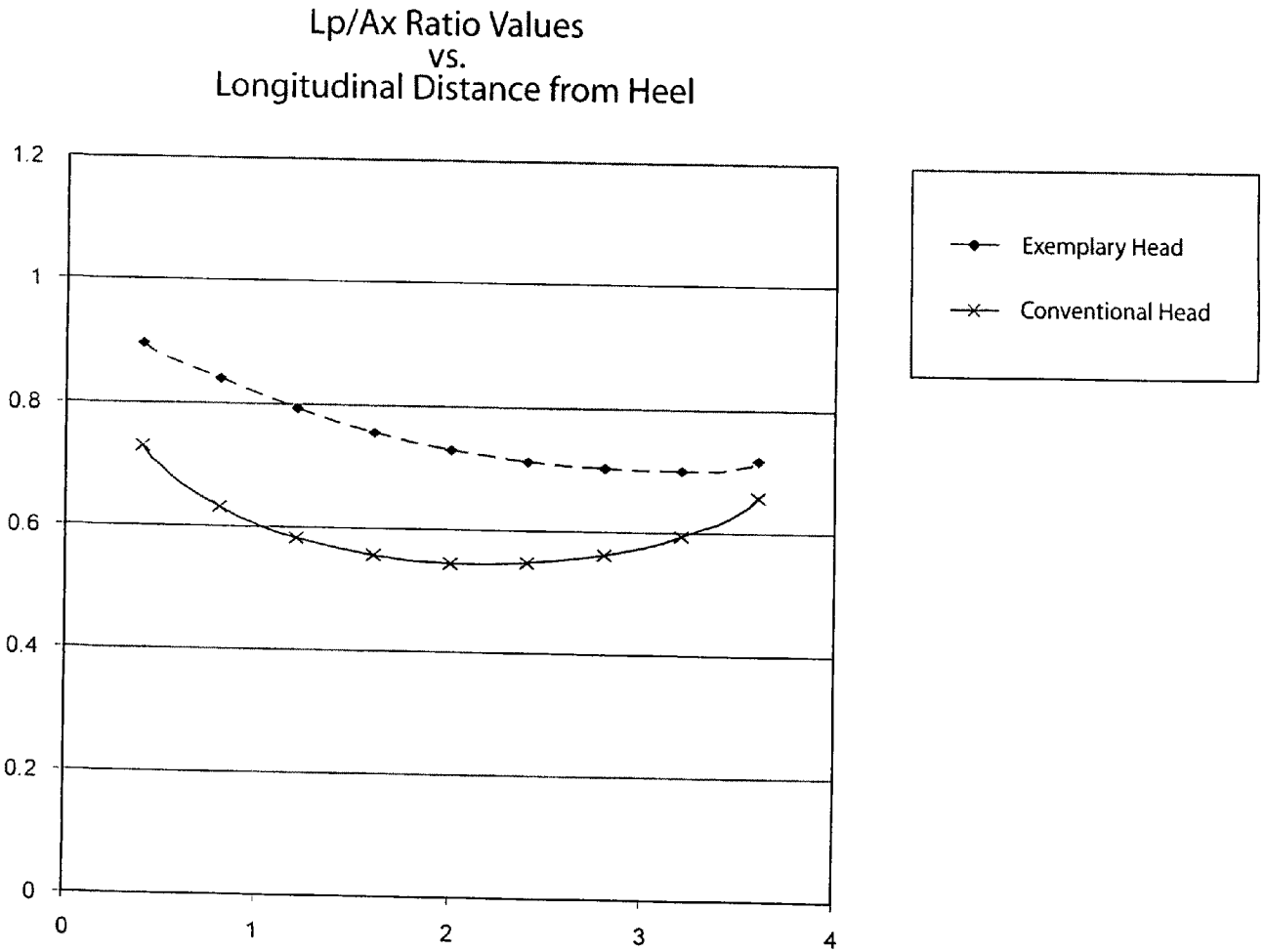
FIG. 11 is a graphical representation of the data retrieved from analysis of the cross-sections taken from the club head of FIG. 1 and depicted in FIG. 10.

FIG. 11 graphically represents the $L_p/A_x$ values from Table 1 plotted according to their transverse position. The results demonstrate greater $L_p/A_x$ ratios for exemplary club head 200, a reflection of the major crown portion's vertical displacement. It is not possible to achieve this distribution of $L_p/A_x$ values in a club head utilizing a conventional, convex crown contour configuration while at the same time maintaining conventional dimensions and proportions in the face and sole. Thus, a metal wood head may achieve the aforementioned performance benefits of increased weight budget and an improved center of gravity location at minimum structural mass by displacing the crown vertically to achieve augmented $L_p/A_x$ values across its transverse span. While all longitudinal sections of the club head according to the above-described exemplary embodiment of the present invention maintain an $L_p/A_x$ ratio above 0.70, adequate performance benefits may be realized by maintaining a minimum $L_p/A_x$ ratio of at least about 0.65. Additionally, a longitudinal section of the club head according to the above-described exemplary embodiment of the present invention reaches an $L_p/A_x$ ratio of about 0.90.

Although there are a series of nine transverse sections used for purposes of comparison between the exemplary club head of the present invention and a selected conventional metal wood, it should be appreciated that an applicable comparison may be performed for virtually any selected conventional metal wood. For example, comparison sections may be modified to include heel, toe, and a transverse midpoint between the heel and toe, such points of reference being available for virtually any metal type wood.

Figure 12:
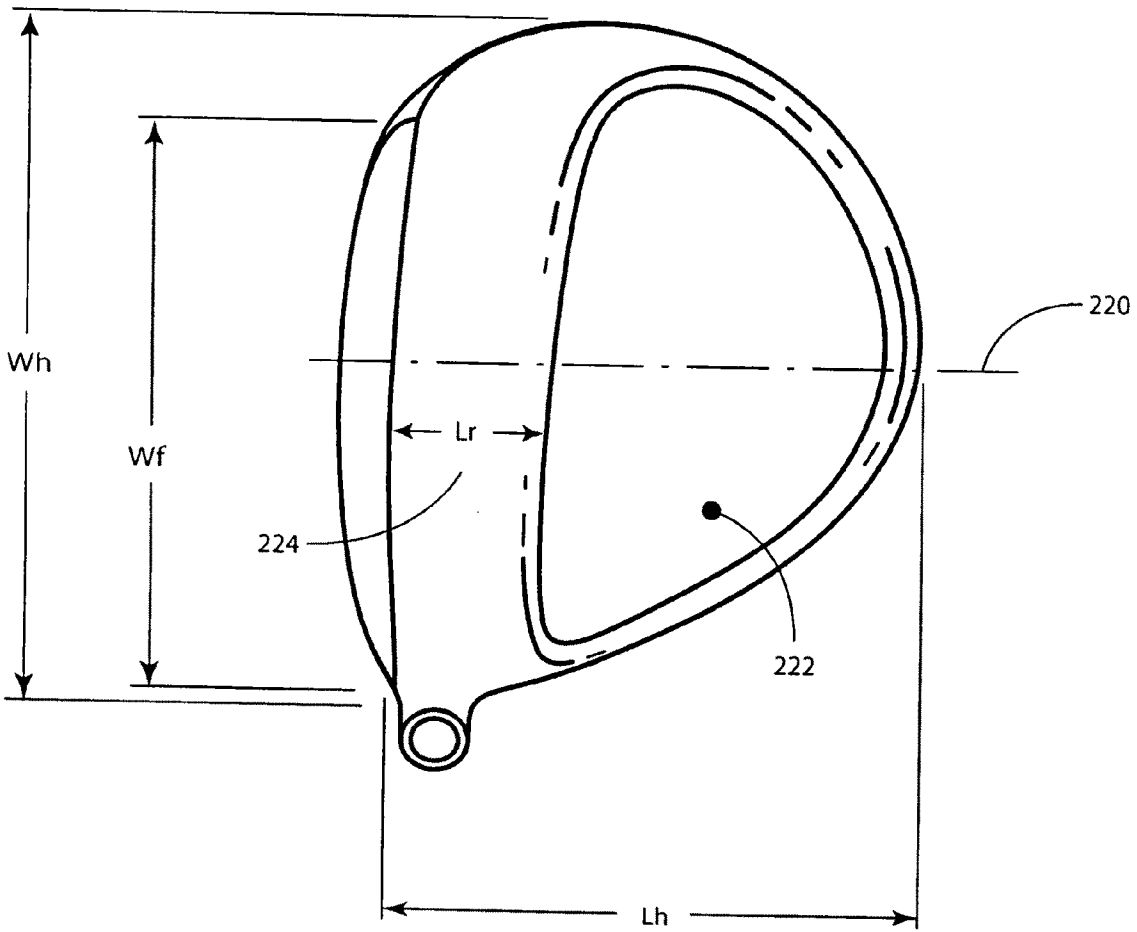
FIG. 12 is a further top view of the club head of FIG. 1.

To achieve a crown contour that ensures encourages confident performance from all types of golfers, including those easily distracted and whose confidence may thereby be readily compromised, it may be desirable to take into consideration more than just the absolute minimum value of the $L_p/A_x$ ratio in the transverse direction. The values of the $L_p/A_x$ ratios in the heel-to-toe direction contribute to the overall confidence some golfers have in club head 200 and enable them to obtain maximum performance from its use. Major crown portion 208's contour yields minimally increasing $L_p/A_x$ ratio values in the transverse direction from the approximate transverse midpoint of head 200 towards the toe. Referring to FIG. 12, the transverse midpoint of head 200 may be represented by a plane 221, which runs longitudinally through head 200 at half the maximum club head width, $W_h$. It should be noted that the measurement of the width $W_h$ does not include the hosel portion 212, but is a measurement from the heel-most to the toe-most extremes of skirt portion 206.

Major crown portion 208 may be gradually inclined in the heel-to-toe direction with its lowest point, represented in FIG. 12 as point 222, located generally between the heel-most extremity of head 200 and axis 221. Progressively raising major crown portion 208 in the heel-to-toe direction causes the outer silhouette of head 200 to remain substantially identical in shape to the outer silhouette of a conventional metal wood head when viewed from a golfer's vantage point at address, and therefore serves to keep head 200 as familiar and appealing to golfers as possible. If all of major crown portion 208 were maintained at a lower vertical position, the resulting silhouette of head 200 might not resemble that of a conventional metal wood head at address. Therefore, this contour of major crown portion 208 may be desirable since it permits a balance between an improved center of gravity location at minimum structural mass, increased weight budget, and a confidence-inspiring head shape.

Referring again to FIG. 12, minor crown portion 210 may further comprise a return portion 224 running between topline edge 218 and the front-most edge of major crown perimeter edge 216. Return portion 224 may have a length, $L_r$, which varies along the transverse direction, and which may have values in the range of about 1 cm to about 4 cm. The size of the return portion 224 aids in providing a more conventional looking crown portion to the club head 220 while enabling a maximum area for major crown portion 208.

Still further, with the exception of at least a portion of crown 211, the remainder of head 200 comprising a primary body 230 (see FIGS. 13-17(*b*)) may be formed primarily of a metallic material. Any metal or alloy may be used to form the individual portions of the primary body, and furthermore, it may be advantageous for more than one of the portions to be formed integrally of the same metal. Portions of body 230 that experience elevated stress levels, for example face 202, may be formed of a different alloy or metal having superior strength characteristics than that which may be used to form the remaining metallic portions of the primary body. Any combination of cold or hot forming, casting, machining, or other known manufacturing techniques may be used to form the portions of body 230 individually, integrally, or as a one piece construction. Should one or more portion(s) of the primary body be formed separately from the others, suitable joining techniques may be used to affix them together including, by way of example, welding, adhesive bonding, press fitting, mechanical fastening, and the like.

Figure 13:
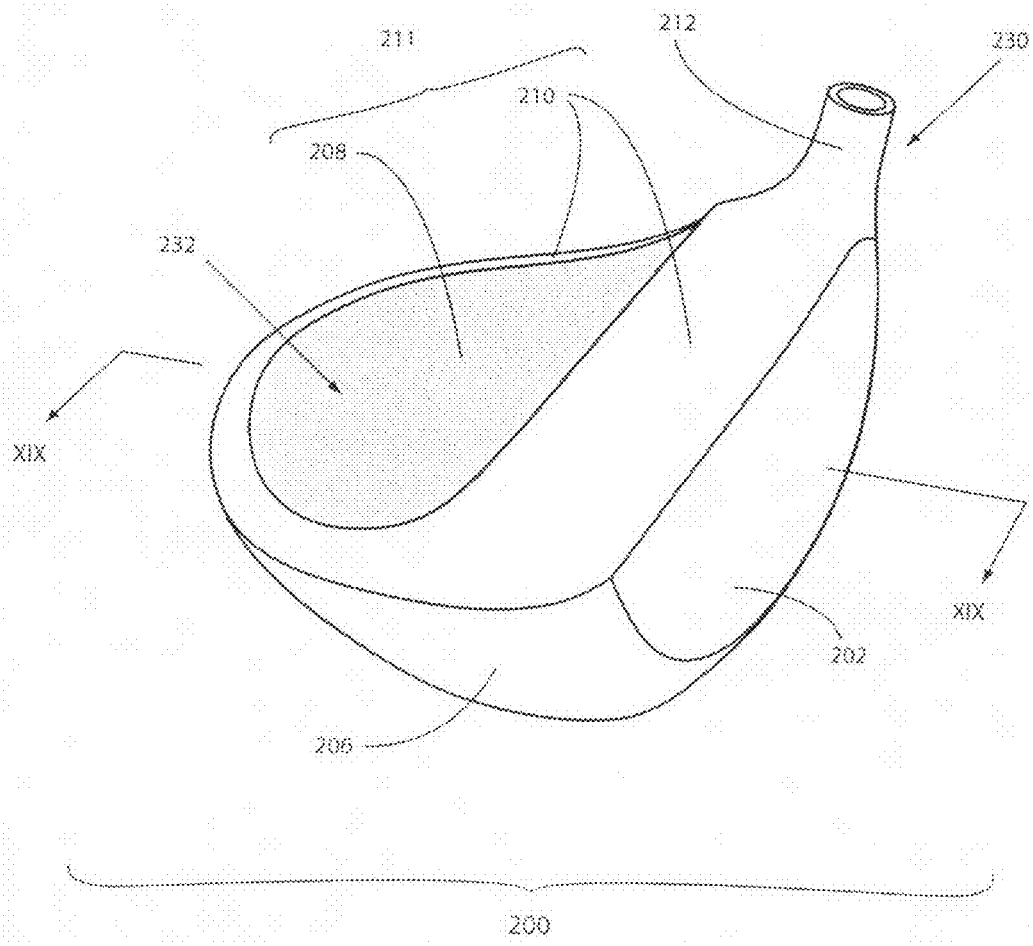
FIG. 13 is a perspective view of a further embodiment of a head like that shown in FIG. 1.

As shown in FIG. 13, crown 211 includes a material dissimilar to the material(s) used to form primary body 230 at least in that the specific strength of the dissimilar material is appreciably greater than the specific strength of the material forming face 202 and/or the remaining portions of the primary body. That portion of the club head utilizing the dissimilar material is defined as an auxiliary body 232. Specific strength is defined as the ultimate tensile strength of a given material divided by that material's density, and for values presented herein may have units of $MPa/g/cm^3$. In one exemplary embodiment, the entire major crown portion 208 is formed from a material having a specific strength that is greater than that of the remainder of the club head.

Figure 14:
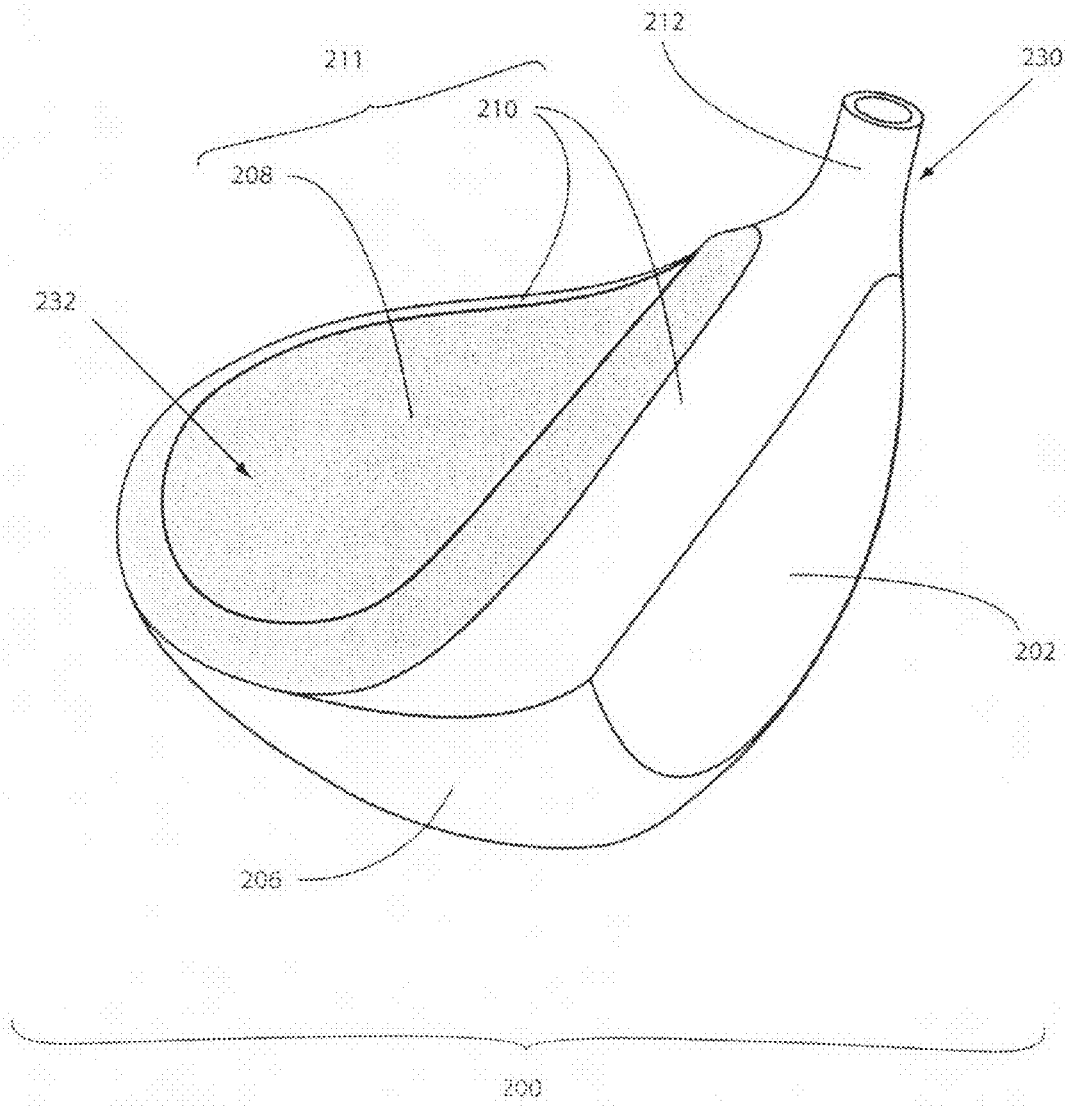
FIG. 14(*a*) is a perspective view of still another embodiment of a head like that shown in FIG. 1.
Figure 14:
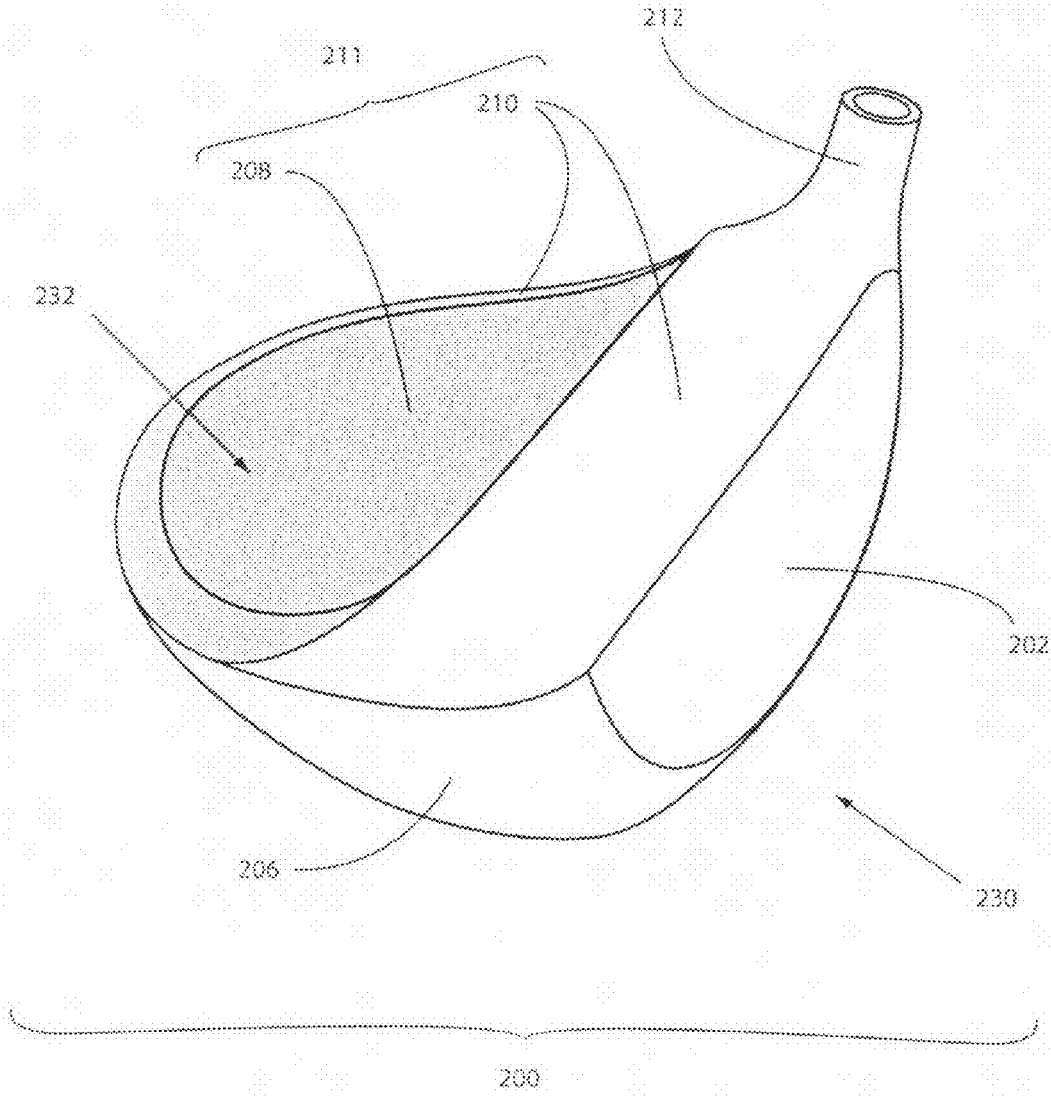
Figure 15:
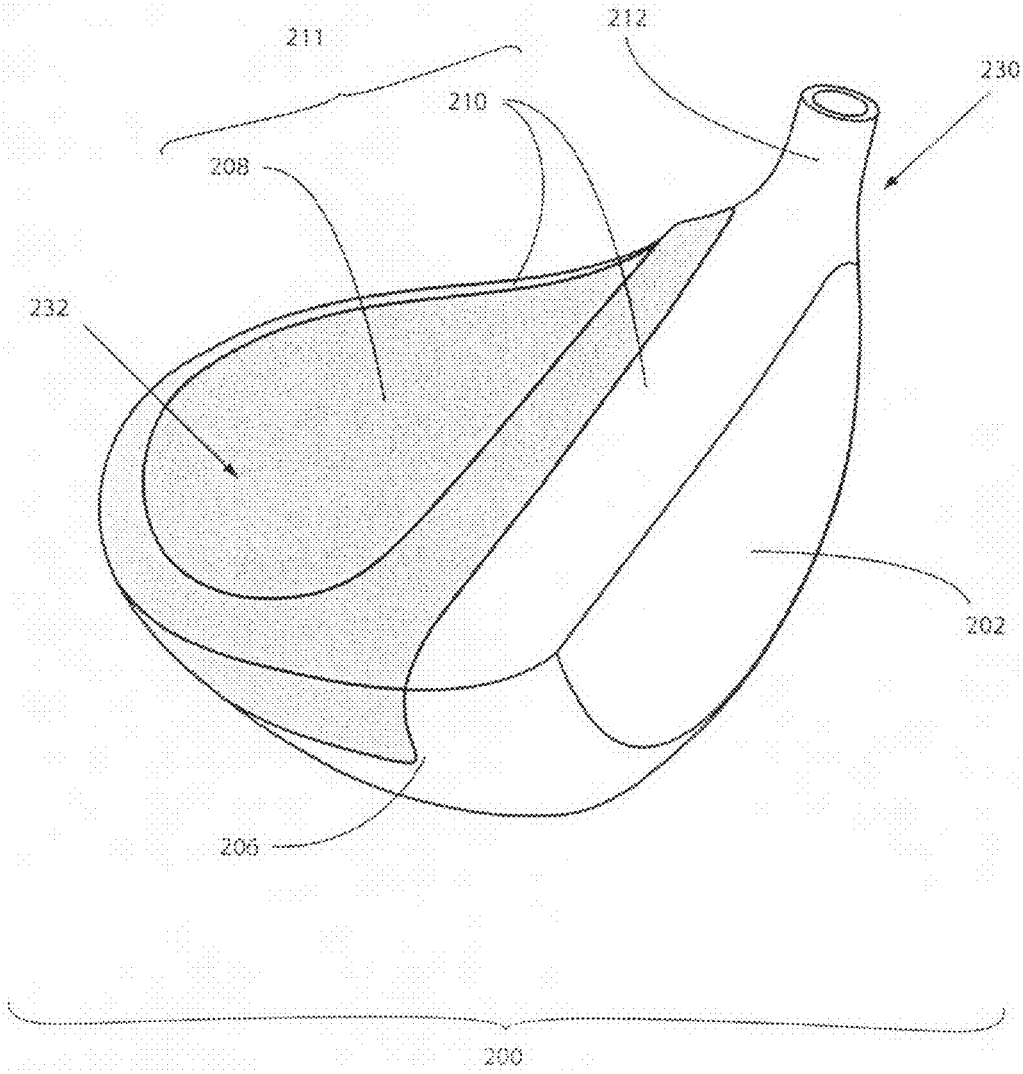
FIG. 15(*a*) is a perspective view of a further embodiment of a head like that shown in FIG. 1.
Figure 15:
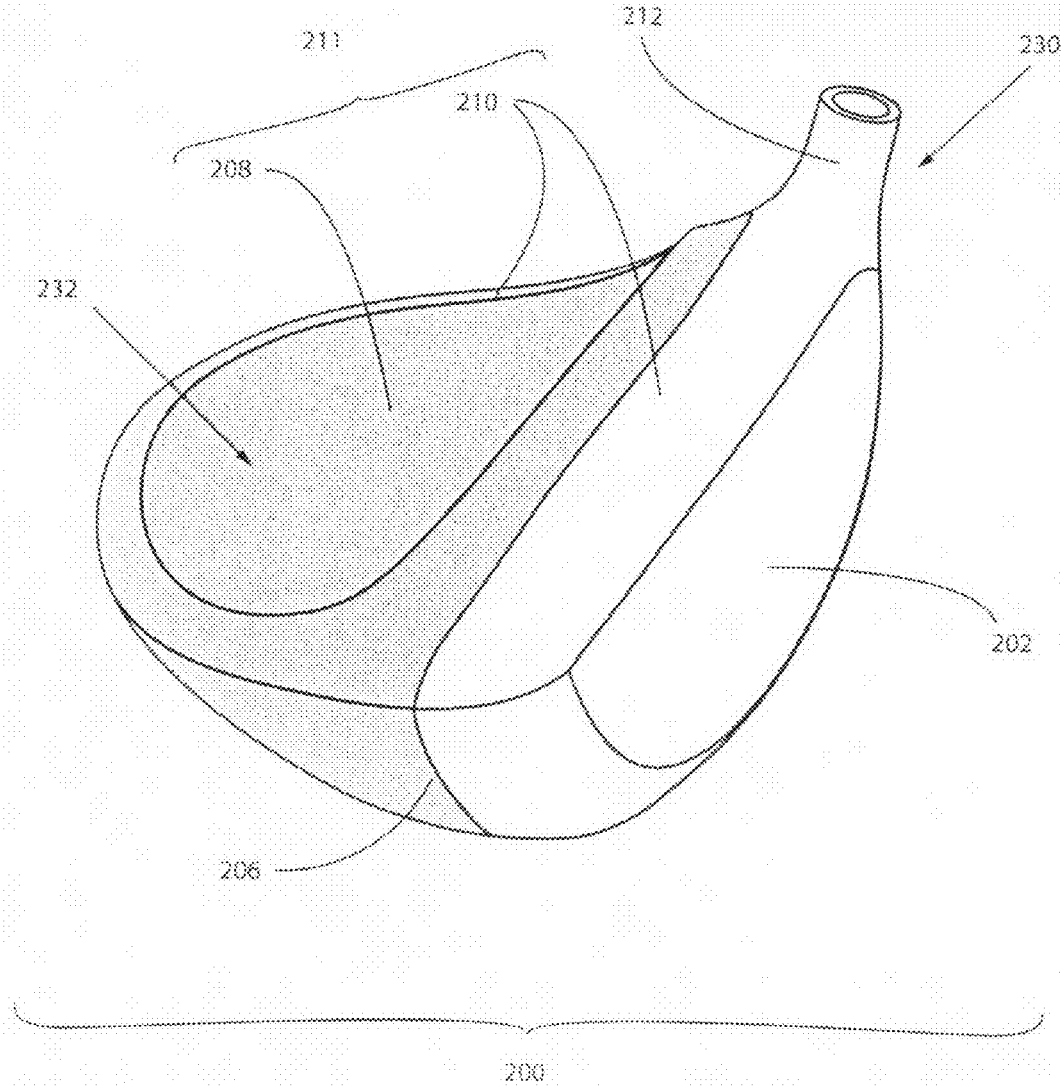
Figure 16:
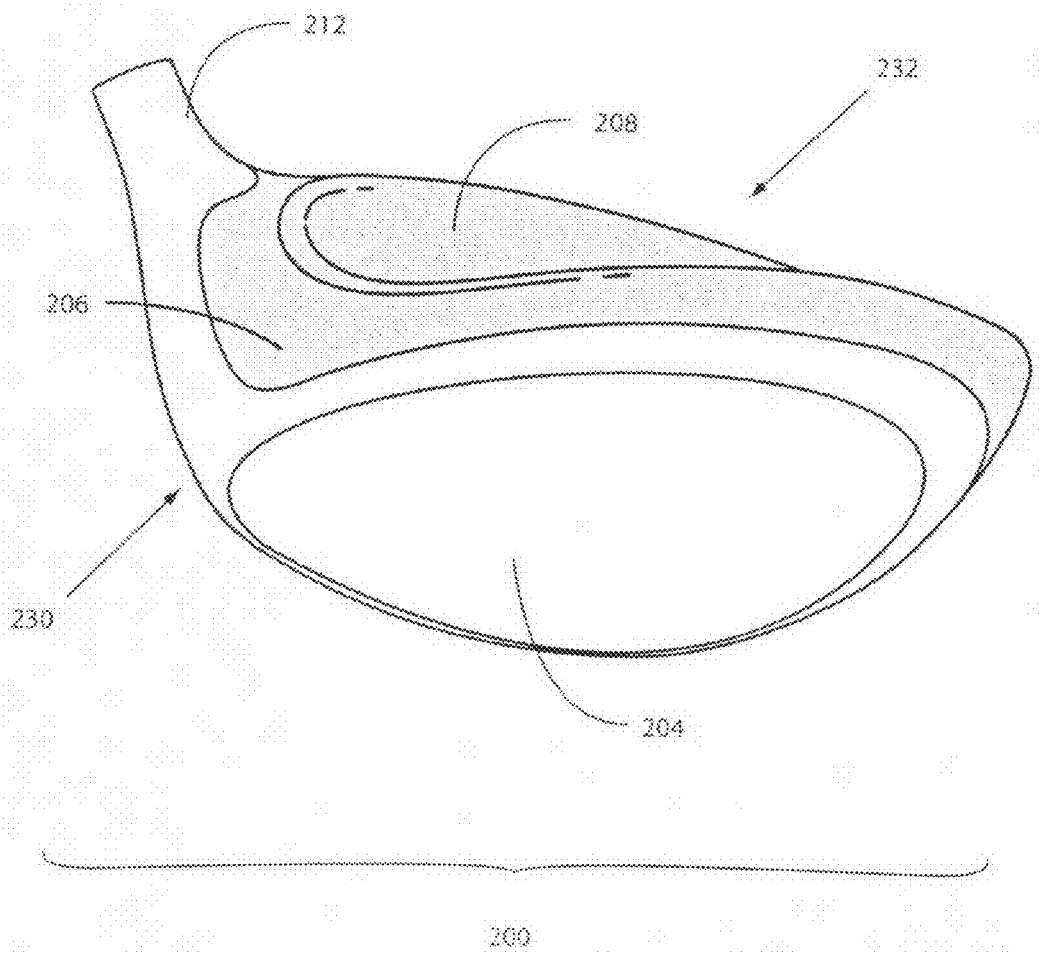
FIG. 16(*a*) is a rear perspective view of the head shown in FIG. 15(*a*)
Figure 16:
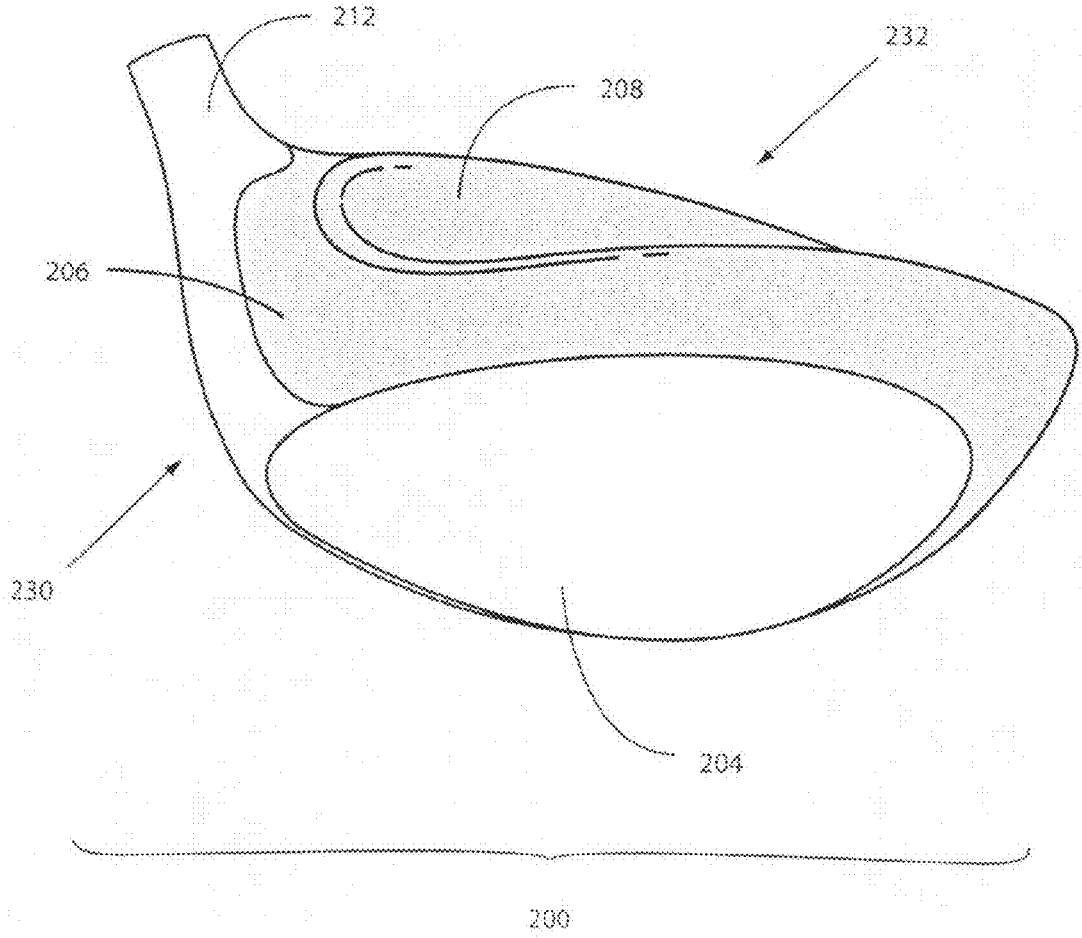
Figure 17:
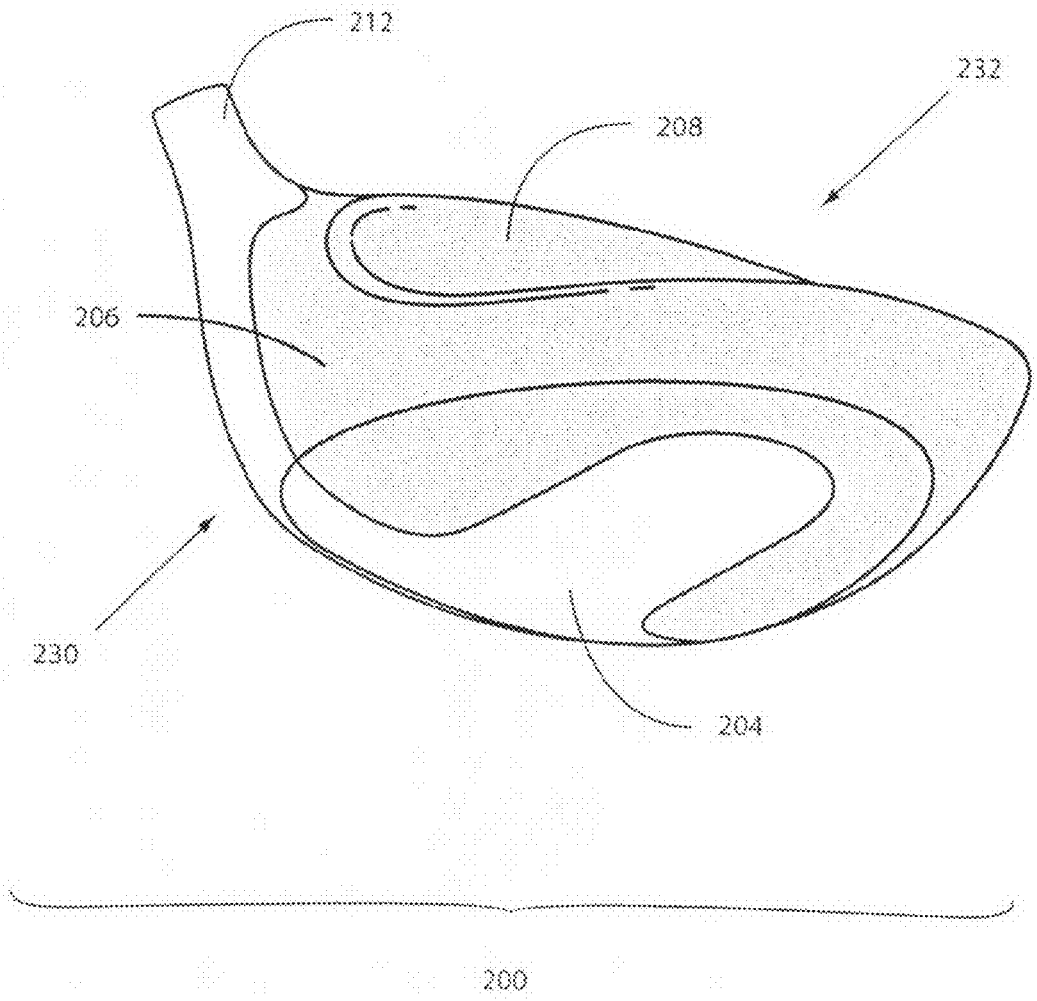
FIG. 17(*a*) is a perspective view of yet another further embodiment of a head like that shown in FIG. 1.
Figure 17:
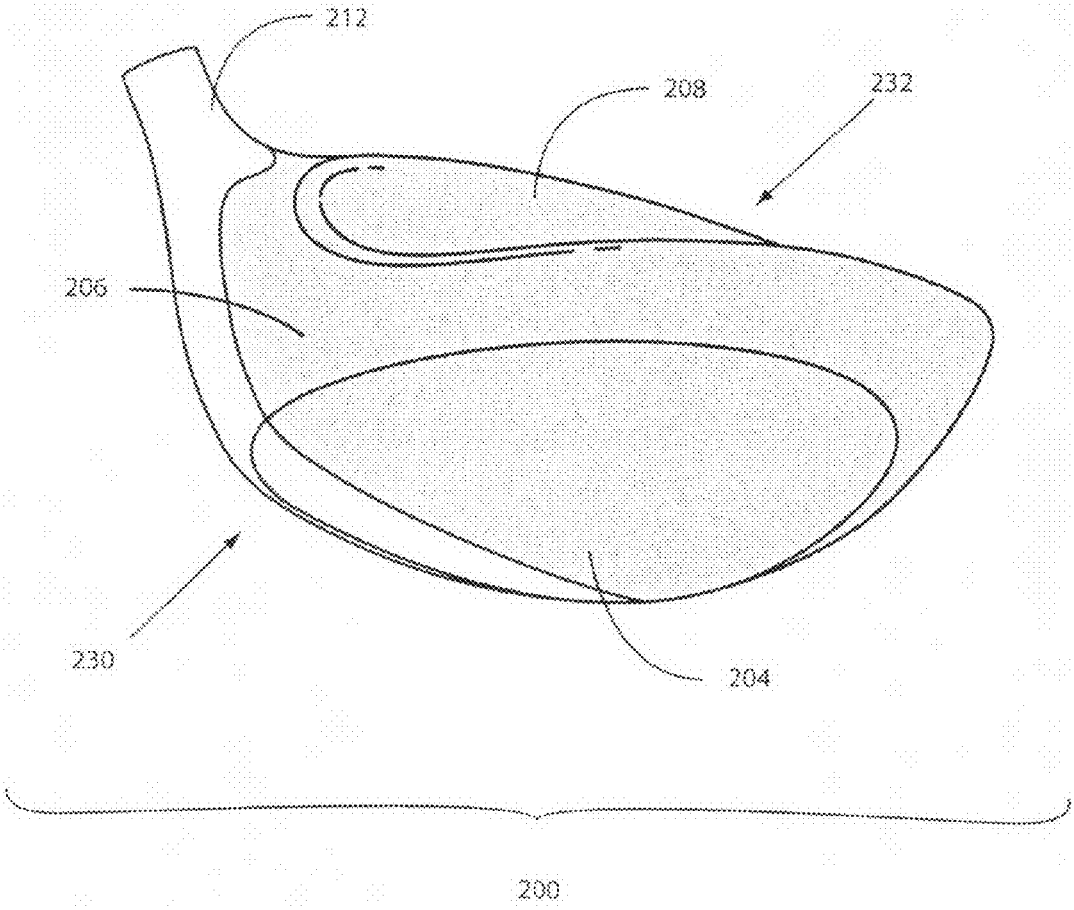

Alternatively, both major crown portion 208 and at least a part of minor crown portion 210 may be made from the dissimilar material, as shown by way of example in FIGS. 14(*a*) and 14(*b*). Further, the dissimilar material may be used to form all or a part of skirt portion 206 in addition to the major crown portion 208 and at least a part of the minor crown portion 210, as shown by way of example in FIGS. 15(*a*), 15(*b*), 16(*a*) and 16(*b*). Further still, the dissimilar material may additionally be used to form all or part of sole portion 204, as shown, for example, in FIGS. 17(*a*) and 17(*b*). Regardless of the specific configuration, in all embodiments the portions integrally formed of the dissimilar material constitute at least one auxiliary body 232.

If steel alloy is used to form the striking face portion of club head 200, exemplary materials for auxiliary body 232 include titanium alloys, aluminum alloys, magnesium alloys, fiber reinforced plastics (FRP), or metal matrix composites. In the case of striking face portions formed from high-strength titanium alloys, which may have specific strengths approaching about 360 $MPa/g/cm^3$, FRP materials may be particularly well suited for use as the dissimilar material. For example, woven fiber cloth pre-impregnated with a thermosetting epoxy resin matrix, or "prepreg", may have specific strengths ranging from about 400 to well over 1000 $MPa/g/cm^3$, depending on the type of weave (e.g. unidirectional, bi-directional), the type of fiber used (e.g. nylon, carbon, glass), the fiber areal weight, type of matrix resin and/or curing process, as well as the ratio of resin to fiber.

Figure 18:
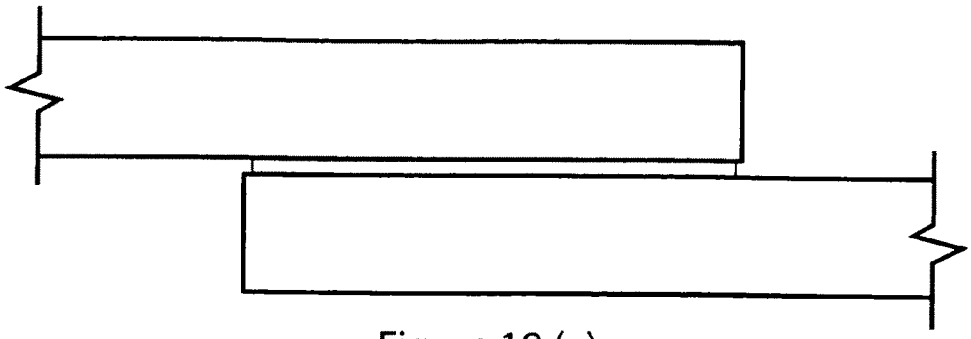
FIG. 18(*a*) is a cross-sectional view of a first exemplary bonded joint type for joining two thin sheets.
Figure 18:
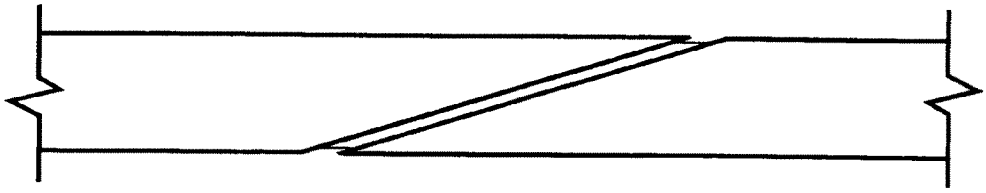
Figure 18:
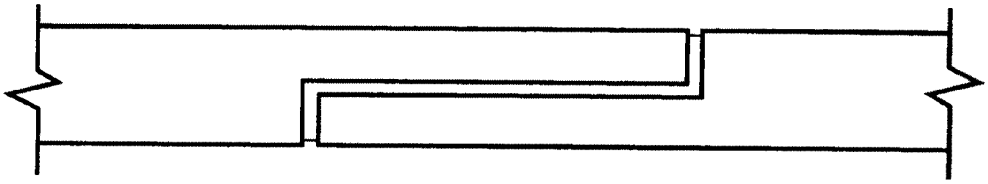
Figure 18:
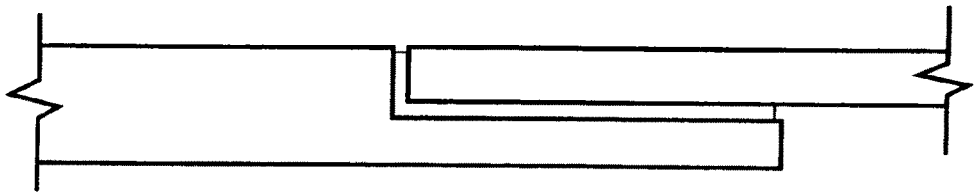
Figure 18:
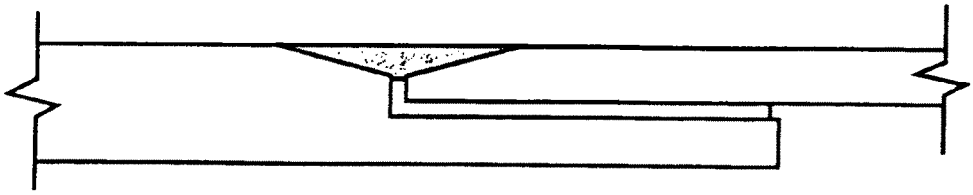

In all embodiments, since auxiliary body 232 is formed of a material that is different than the material(s) used to form primary body 230, mechanical fastening and/or adhesive bonding is employed to interconnect the bodies and thus form a unitary body, i.e. head 200. The principles of joining thin sheets by means of adhesive bonding are well-known, and may be employed to join the primary and auxiliary bodies. Exemplary bonded joint types include simple lap joints (see FIG. 18(*a*)), scarf joints (see FIG. 18(*b*)), single- and double-step lap joints, (see FIGS. 18(*c*) and (*d*), respectively), as well as reinforced stepped lap joints (see FIG. 18(*e*)).

Figure 19:
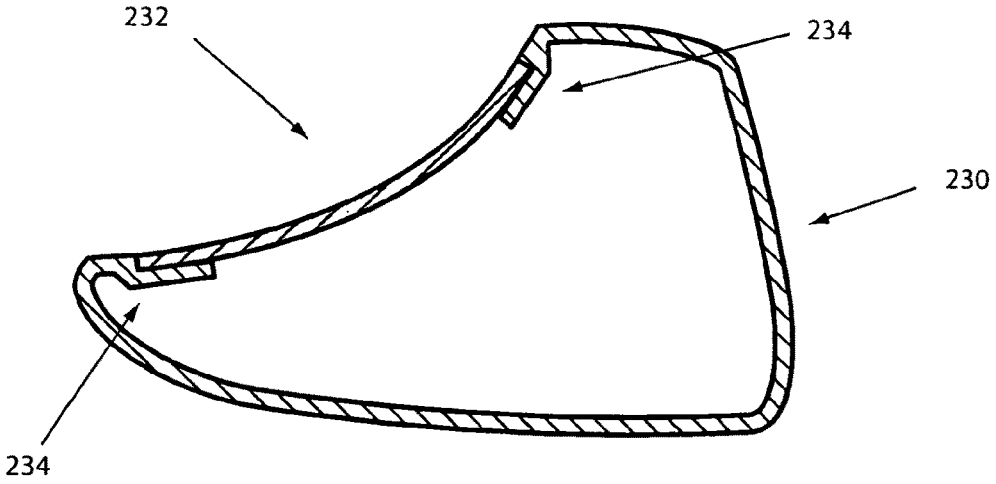
FIG. 19(*a*) is a cross-sectional view of one variation of the fourth exemplary joint configuration as adapted to the head of FIG. 13, where the section is taken at line XIX-XIX.
Figure 19B:
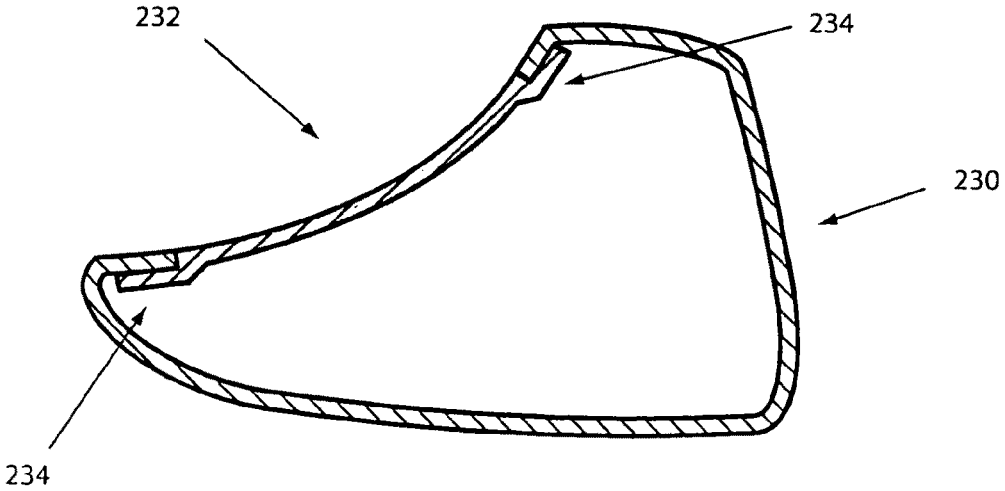
Figure 19:
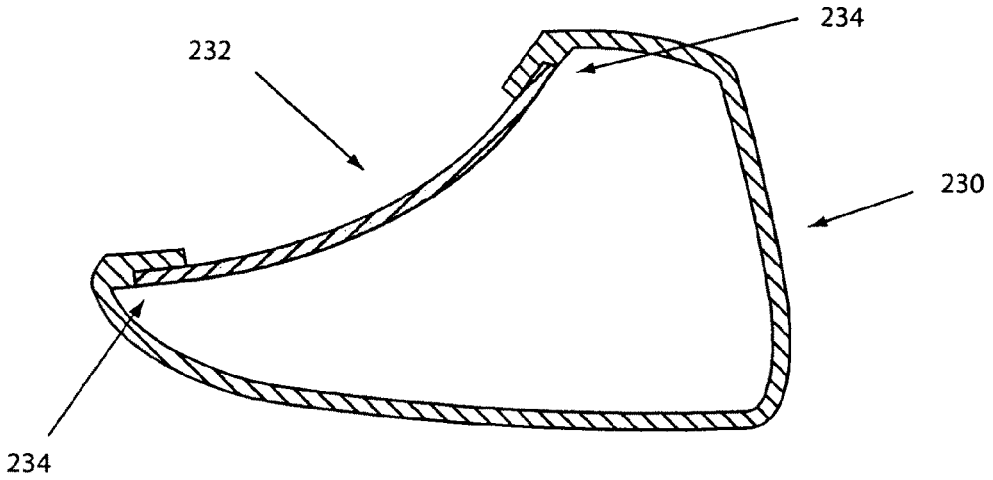
Figure 19D:
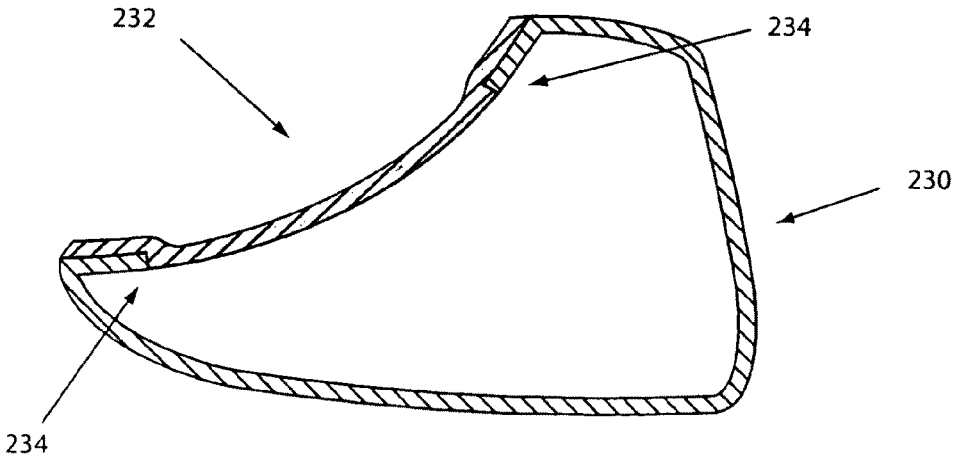
Figure 20:
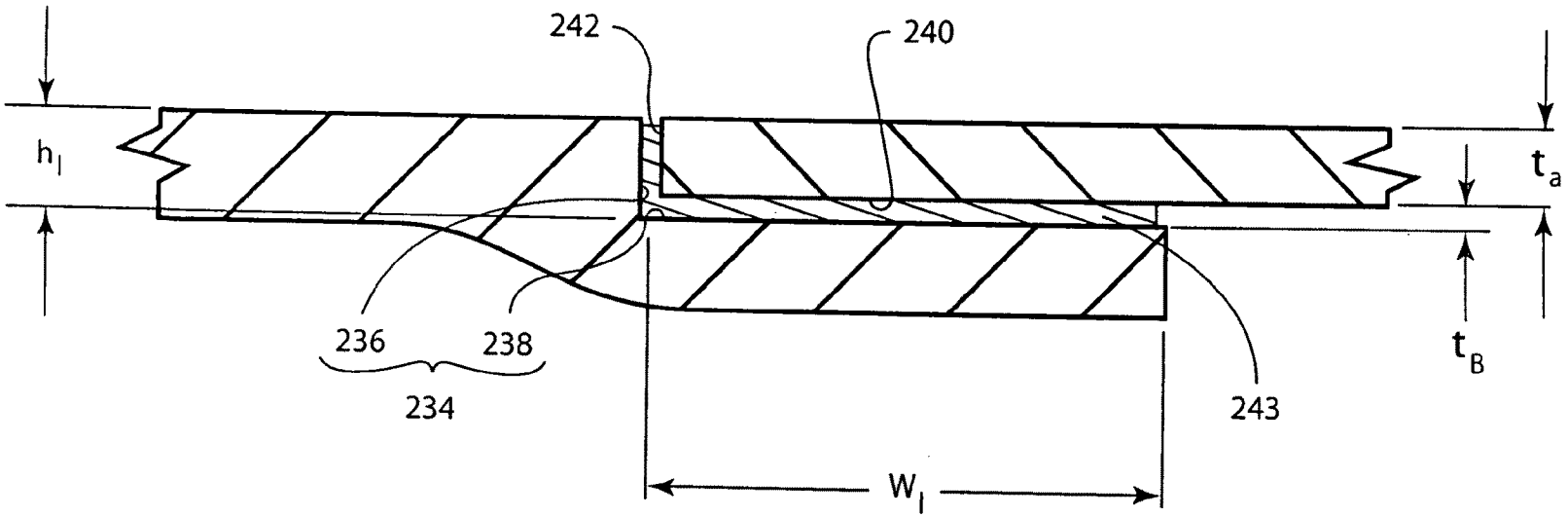
FIG. 20(*a*) is an enlarged sectional view showing more detail of the exemplary joint configuration shown in FIG. 18(*d*)
Figure 20:
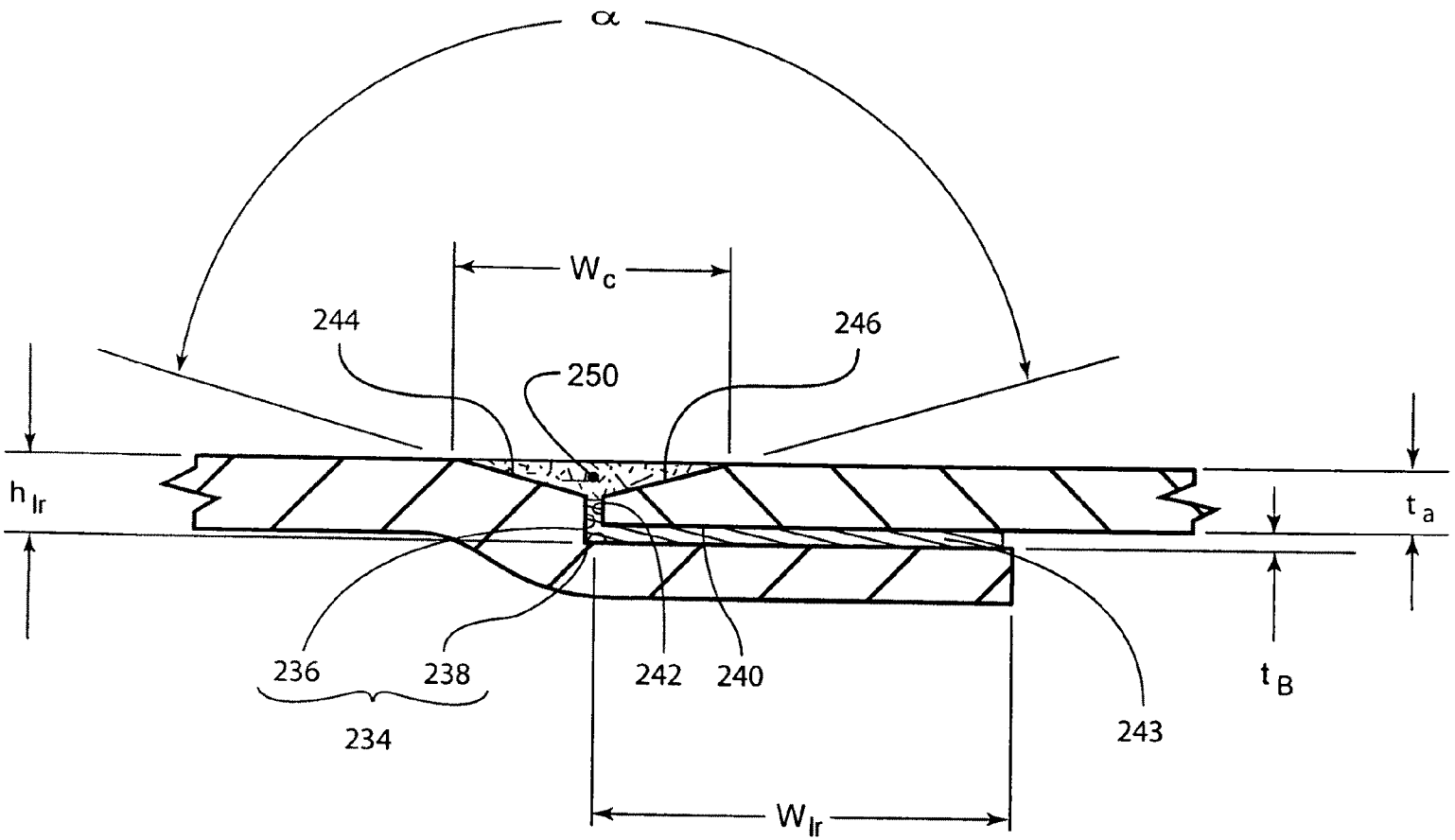
Figure 20:
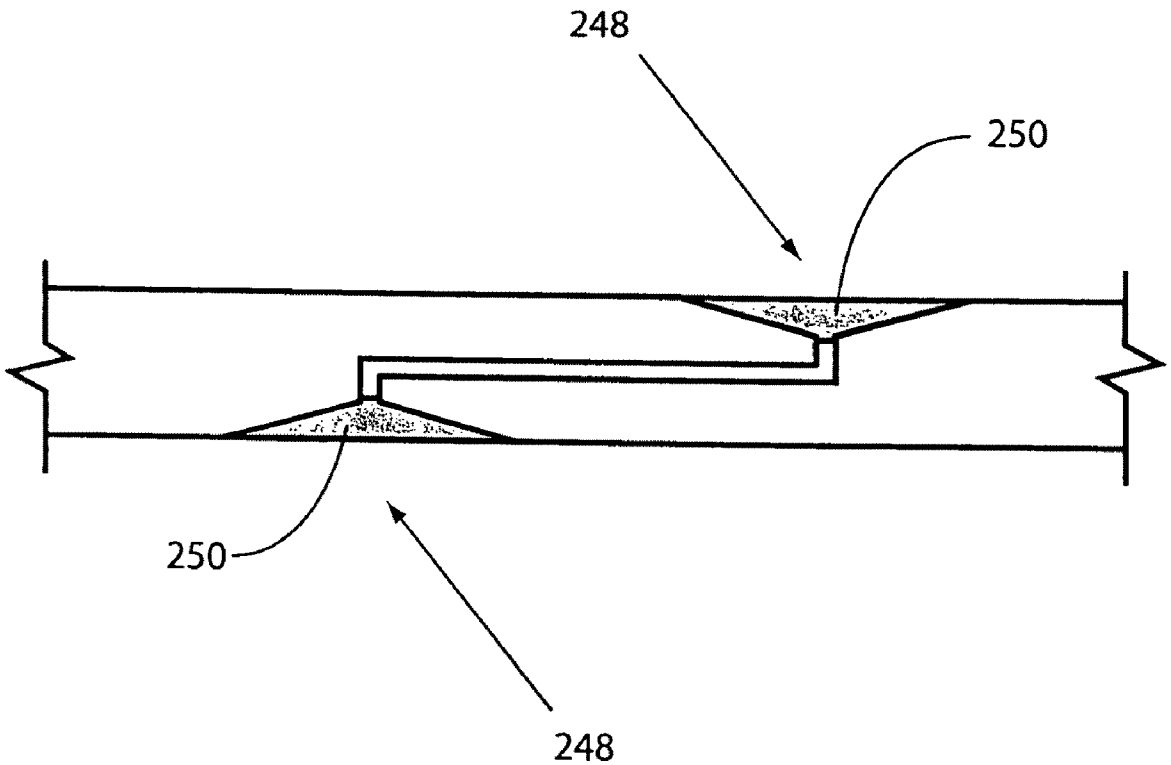

In the exemplary case of a single-step lap joint (see FIG. 20(*a*)), which provides excellent bond strength, either the primary body or the auxiliary body is provided with a step 234, comprising a first abutment surface 236 and a first lap surface 238 that are generally perpendicular to each other. A corresponding second lap surface 240 and a second abutment surface 242 are formed in the other body, where the second abutment surface may be the surface that separates the interior and exterior surfaces of said other body. Step 234 may be formed into the outwardly facing surface of the primary body or auxiliary body, as shown in FIGS. 19(*a*) and 19(*b*), or the inwardly facing surface of the primary or auxiliary bodies as shown in FIGS. 19(*c*) and 19(*d*), respectively. As seen in these figures, the second lap surface may conveniently comprise a portion of the inwardly or outwardly facing surfaces of the body that is not provided with said step. Alternatively, a double-step lap joint generally illustrated in FIG. 18(*c*) may be utilized. However this adds complexity to the design, and may be used at the discretion of the designer after weighing the costs and benefits of its implementation.

Adhesive, for example Hysol™ two part epoxy 9460 or 3M™ DP460NS may be applied to either lap surface, or the body portions may be affixed together by the application of a force generally normal to the lap surface. For example, if the step is provided in the outwardly facing surface of the primary body 230 or the inwardly facing surface of the auxiliary body 232, the generally normal force may be applied through the use of cellophane wrap, heat shrink wrap, or elastic band(s) (not shown) wrapped around the exterior surface of head 200. If the step is provided in the inwardly facing surface of the primary body 230 or the outwardly facing surface of the auxiliary body 232, an inflatable bladder may be inserted through an access port formed in either body (not shown), and inflated to the desired pressure. In any of the preceding exemplary techniques, a normal force may thus be applied for any time required to cure the adhesive may require, thereby ensuring maximum reliability of the bond.

The adhesive separates the primary and secondary bodies by its application thickness, which is known as the bondline thickness, $t_B$. For the exemplary adhesives given above, bondline thickness $t_B$ may generally be in a range from about 5 mil (0.1270 mm) to about 10 mil (0.254 mm). For an exemplary lap surface width, $w_1$, of 7 mm, this would result in an average 0.175 g of adhesive for every centimeter of bondline length. Typically, about 0.5 g to about 1.0 g of adhesive will be required to adhere the auxiliary body to the primary body, depending on the adhesive used, the specific joint design, as well as the bondline thickness recommended by the manufacturer. Regardless of the adhesive selected, the specific bondline thickness will ultimately depend on the material types chosen by the club head designer for primary body 230 and auxiliary body 232.

Prior to bonding the auxiliary body 232 to the primary body 230, lap surfaces 238 and 240 may be prepared using a variety of techniques. The metallic primary body and the auxiliary body may be cleaned with solvents or alcohols, and subsequently subjected to a chemical etching process, sandblasting, or manual etching using an abrasive cloth or paper. Etching the surface using any of the above three techniques will increase the adhesive's effectiveness, thereby reducing the likelihood of failure at the bonded joint. It should be noted that, given the inherent disparity between the materials of the primary and auxiliary bodies, not all solvents and chemical etching processes will be compatible for use on both lap surfaces 238 and 240.

The lap joint may be continuously formed along the entire interface between the primary and auxiliary bodies, or may be manifested as a series of spaced tabs (not shown), provided such tabs afford sufficient bonding area to withstand the loads imposed by the impact of striking surface portion 202 with a golf ball. If the lap joint is continuous along the entire interface of the primary and auxiliary bodies and referring again to FIG. 20(*a*), by way of example only, the lap surfaces may have a width, $w_1$, of at least about 5 mm, and generally not greater than about 20 mm. The abutment surface has a height, $h_1$, which generally corresponds to a thickness, $t_a$, less bondline thickness $t_B$, where thickness $t_a$ is the thickness of the body portion bonded to lap surface 238.

Figure 21:
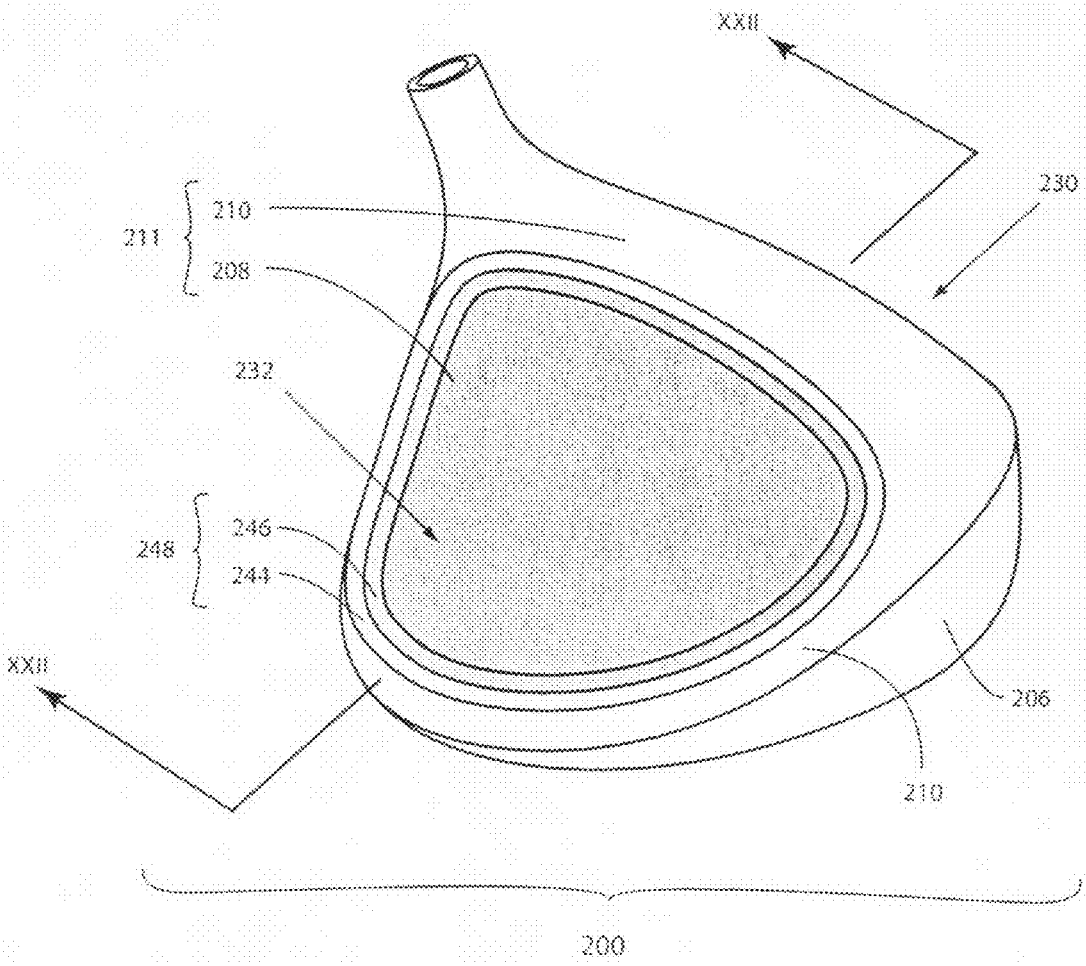
FIG. 21 is a perspective view of a further embodiment of the exemplary head of FIG. 13, including a channel feature.
Figure 22:
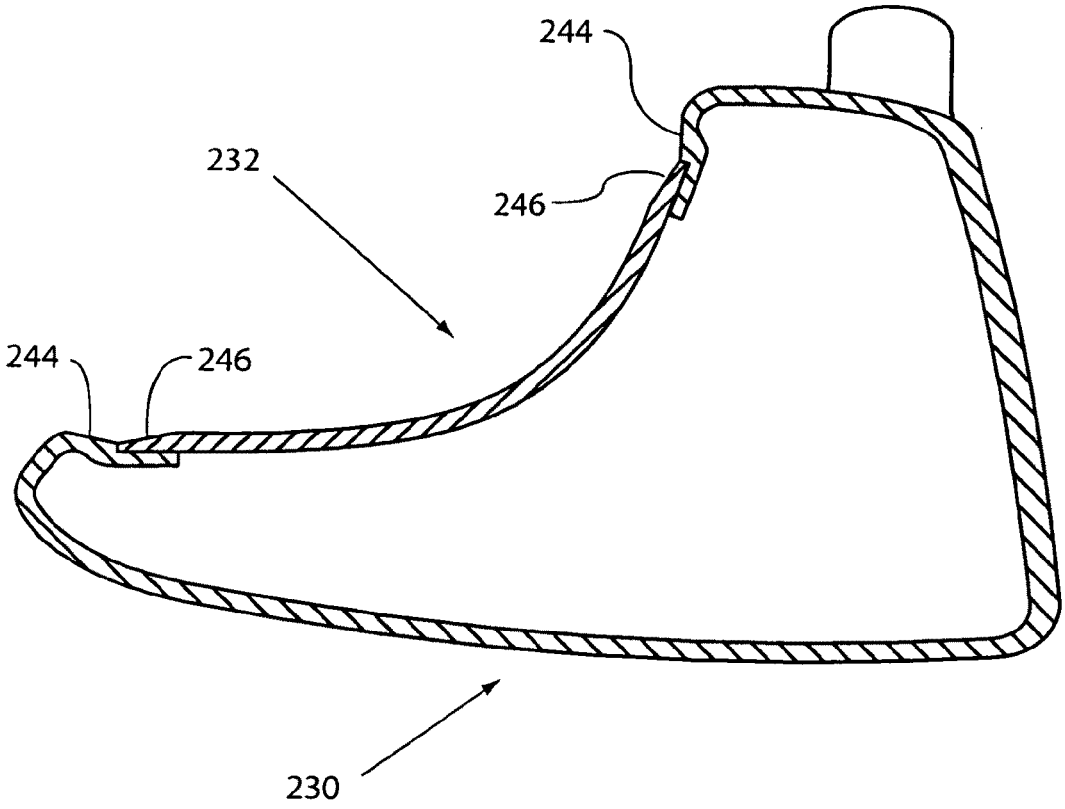
FIG. 22 is a cross-sectional view of the exemplary head of FIG. 21, taken at line XXII-XXII.

While step lap joints provide good bond characteristics, reinforced step lap joints provide superior resistance to cracking of surface treatments (e.g. paint, clear coat, etc.) applied to the exterior surface of head 200, particularly along the interface between the primary and auxiliary bodies. In addition, reinforced lap joints have greater overall bond reliability in comparison to the other bonded joint types considered herein. For these reasons, reinforced lap joints may be particularly well-suited for use in bonding the auxiliary body 232 to the primary body 230. A reinforced step lap joint is shown in FIG. 20(*b*) having the same elements as the stepped lap joint configuration considered above, and wherein a first bevel 244 is provided on the surface of the body into which step 234 is formed. A complementary second bevel 246 may be provided on the other body such that the two bevels form a channel 248 extending along the entire interface of the primary and auxiliary bodies, as shown in FIGS. 21 and 22. Referring back to FIG. 20(*b*), the two bevels generally form an included angle, $\alpha$, having a value that is greater than about 90 degrees and less than about 160 degrees, and may have a channel width, $w_c$, ranging from about 5 mm to about 15 mm. The reinforced step lap joint may be configured such that channel 248 is located either on the exterior or the interior of the club head. Moreover, a step joint having both interior and exterior channels may be utilized (see FIG. 20(*c*)). Referring to FIGS. 20(*a*), 20(*b*), and 20(*c*), channel 248 may be provided with a reinforcement material 250, for example an epoxy resin reinforced with at least one layer of a glass, nylon, or carbon fiber tape. Once the reinforcement material has been applied and allowed to cure (if necessary), sanding and/or grinding may be carried out to achieve a smooth, continuous look to the exterior surface of the golf club head 200. The head may then be prepared for finishing, if desired.

Typical wall thicknesses for various regions of the primary and auxiliary bodies may generally be between about 0.6 mm and about 2 mm, depending on the locations, and the structural requirements of said regions, as well as the respective materials used to fabricate the bodies. Striking face portion 202 is subjected to the greatest loads, and may therefore be an exception to the general thickness range given above. The striking face portion may typically have a thickness ranging from about 1.5 mm to about 4.0 mm. Another exception to the aforementioned range of thicknesses may arise should the club head designer choose to increase the thickness at a particular region of head 200 to provide a local mass concentration, thereby expending some or all of the weight budget. This method may be particularly effective if the thickened region is provided on a portion of the body made from a metallic material, i.e., on primary body 230. For example, the club head designer may provide a thickened region (not shown) in a part of sole portion 204 distal from striking face portion 202, in an attempt to displace the club head's center of gravity deeper and lower within the head.

Alternative means for expending weight budget within head 200 include the use of weight members made from relatively high-density materials in relation to those used to construct the remaining portions of head 200. Such weight members may be strategically placed on internal or external surfaces of the head, or may be used to replace sections of any portion of the head. Weighting of metal wood club heads is commonly practiced in the art of golf club construction, and any and all compatible weighting techniques may be used to expend weight budget afforded by the head configurations taught herein.

Figure 23:
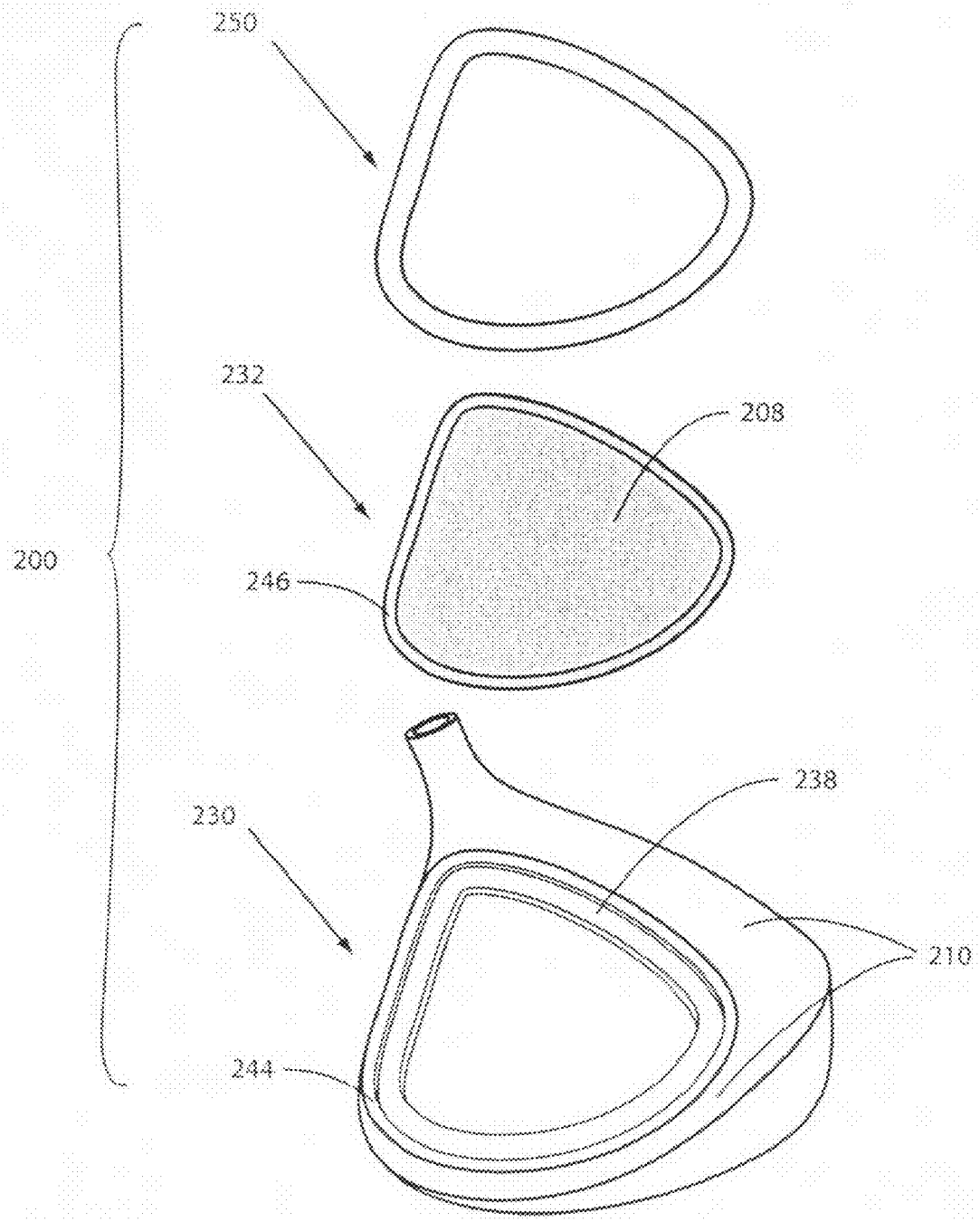
FIG. 23 is an exploded perspective view of the exemplary head of FIG. 13, shown with a channel feature as well as reinforcement material.

An exemplary club head, according to the additional principles outlined herein, may have a volumetric displacement of about 337 $cm^3$, and proportions generally consistent with those of a conventional metal wood head displacing about 420 $cm^3$. In this embodiment of the invention, illustrated in FIG. 23, major crown portion 208 may be manufactured entirely from a carbon fiber reinforced plastic material, which includes three plies of high fracture toughness, uni-directional prepreg roving oriented at +45°, −45°, and 0°, an exterior-most ply of a light-weight bi-directional prepreg weave oriented at 0°/90°, and a thermosetting epoxy-resin matrix comprising about 40% and about 55% of the above-mentioned prepreg types, respectively, by weight. In this embodiment, the major crown portion forms the auxiliary body 232 of club head 200 and, when constructed using the aforementioned exemplary lay-up schedule and a compression-molding process, may have a finished thickness that is generally uniform at about 1.0 mm. Striking face portion 202 (not shown) may be manufactured from a high-strength titanium alloy including about 4.5% aluminum, about 3% vanadium, about 2% molybdenum, about 2% iron, and up to about 0.15% oxygen, and may have a constant thickness of about 2.9 mm. To form primary body 230, the striking face portion may be welded to the remaining portions, which may be integrally cast from, e.g., a Ti 6Al4V alloy using thin wall casting techniques to yield a generally uniform thickness of about 1.2 mm throughout. In this embodiment, major crown portion 208 may occupy about 60 $cm^2$ of the exterior surface area of the club head and have a mass of about 8 g. If made from the same Ti 6Al4V alloy as the primary body, major crown portion 208 would have a mass of about 33 g. As shown in FIG. 23, a reinforced step lap joint configuration may be employed to join the composite major crown portion 208 to primary body 230, additionally requiring about 9 g of titanium to form lap surface 238. Further, about 1.3 g of thermosetting epoxy resin and carbon fiber tape may be additionally provided in channel 248 to reinforce the stepped lap joint. Thus, a net savings of about 15 g may be realized and added to the weight budget of head 200, thereby enabling further improvements to the finished club head's mass properties.

Figure 24:
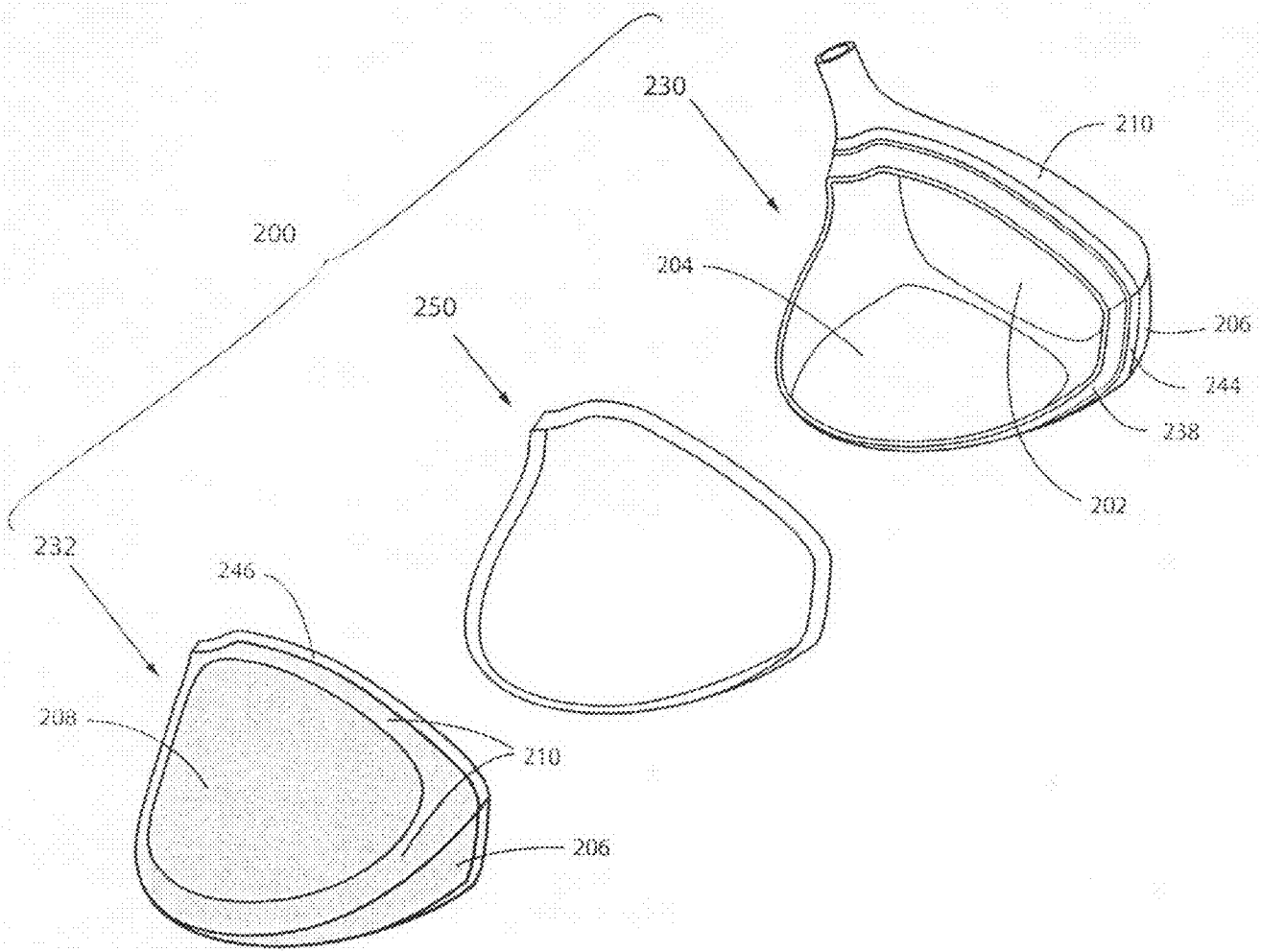
FIG. 24 is an exploded perspective view of the exemplary head of FIG. 15(*a*), shown with a channel feature as well as reinforcement material.

Another exemplary club head in accordance with the principles outlined herein may have a volumetric displacement of about 337 $cm^3$, and proportions generally consistent with those of a conventional metal wood head displacing about 420 $cm^3$. In this embodiment of the invention, illustrated in FIG. 24, all of major crown portion 208, and parts of minor crown portion 210 and skirt portion 206 may form auxiliary body 232, which may be manufactured entirely from a carbon fiber reinforced plastic material including three plies of high fracture toughness, uni-directional prepreg roving oriented at +45°, −45°, and 0°, an exterior-most ply of a light-weight bi-directional prepreg weave oriented at 0°/90°, and a thermosetting epoxy-resin matrix comprising about 40% and about 55% of the above-mentioned prepreg types, respectively, by weight. Using this lay-up schedule and a compression-molding process, auxiliary body 230 may have a finished thickness that may be generally uniform at about 1.0 mm. Striking face portion 202 may be manufactured from a high-strength titanium alloy including about 4.5% aluminum, about 3% vanadium, about 2% molybdenum, about 2% iron, and up to about 0.15% oxygen, and may have a constant thickness of about 2.9 mm. To form primary body 230, the striking face portion may be welded to the remaining portions, which may be integrally cast from, e.g., a Ti 6Al 4V alloy using thin wall casting techniques to yield a generally uniform thickness of about 1.2 mm throughout. In this embodiment, auxiliary body 232 may occupy about 154 $cm^2$ of the exterior surface area of the club head and has a mass of about 22.2 g. If made from the same Ti 6Al 4V alloy used in the primary body, the auxiliary body would have a mass of about 84 g. As shown in FIG. 24, a reinforced step lap joint configuration may be employed to join the auxiliary body 232 to primary body 230, additionally requiring about 13 g of titanium to form lap surface 238. Further, about 1.7 g of thermosetting epoxy resin and carbon fiber tape may be additionally provided as element 250 to reinforce the stepped lap joint. Thus, a net savings of about 47 g may be realized and added to the weight budget of head 200, thereby enabling further improvements to the finished club head's mass properties.

Figure 25:
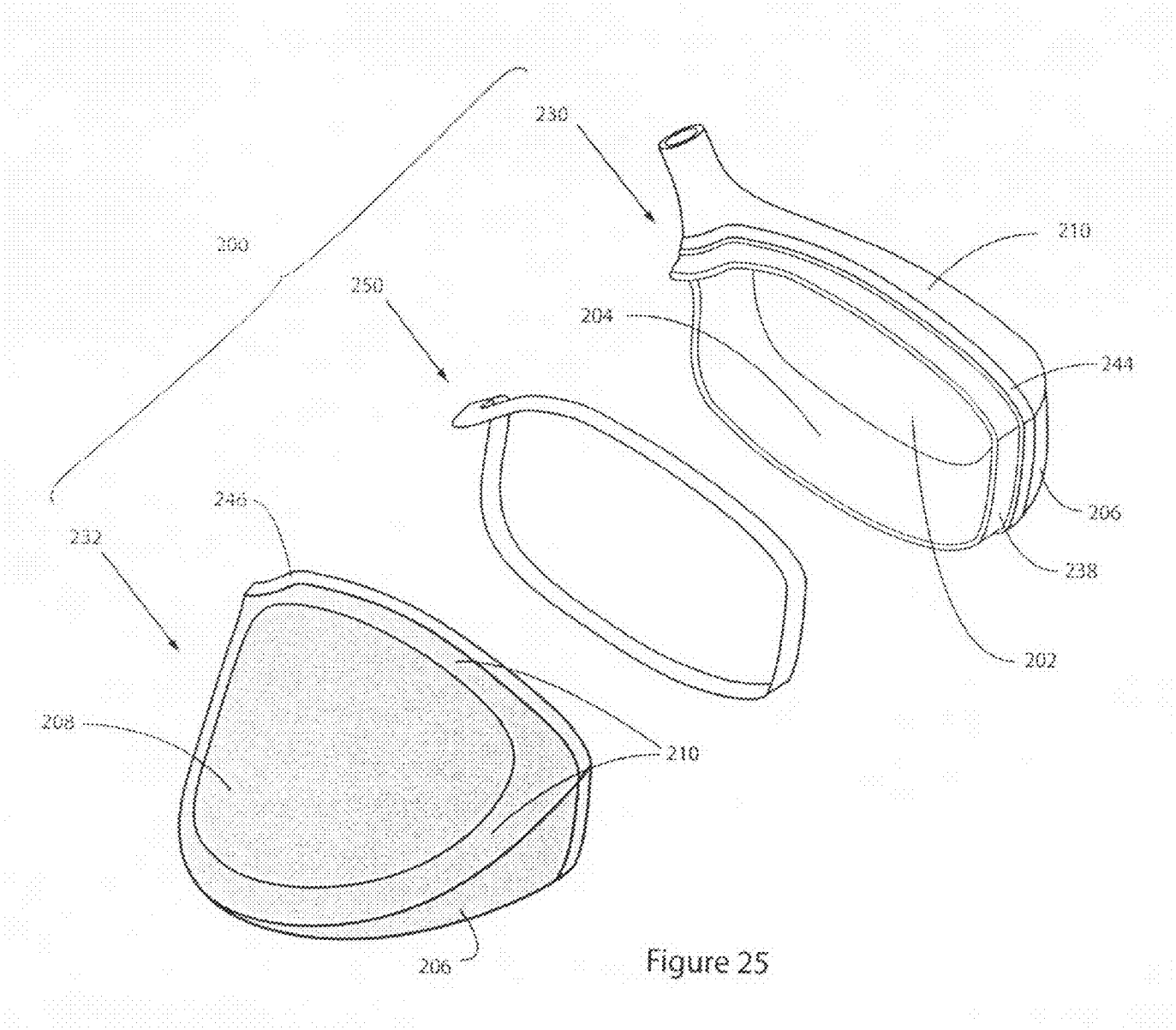
FIG. 25 is an exploded perspective view of the exemplary head of FIG. 16(*b*), shown with a channel feature as well as reinforcement material.

Yet another exemplary club head in accordance with the principles outlined herein may have a volumetric displacement of about 337 $cm^3$, and proportions generally consistent with those of a conventional metal wood head displacing about 420 $cm^3$. In this embodiment of the invention, illustrated in FIG. 25, all of major crown portion 208, part of minor crown portion 210 and the majority of sole portion 204 and skirt portion 206 may form auxiliary body 232, which may be manufactured entirely from a carbon fiber reinforced plastic material including three plies of high fracture toughness, uni-directional prepreg roving oriented at +45°, −45°, and 0°, an exterior-most ply of a light-weight bi-directional prepreg weave oriented at 0°/90°, and a thermosetting epoxy-resin matrix comprising about 40% and about 55% of the above-mentioned prepreg types, respectively, by weight. Using this lay-up schedule and a compression-molding process, auxiliary body 232 may have a finished thickness that may be generally uniform at about 1.0 mm. Striking face portion 202 may be manufactured from a high-strength titanium alloy including about 4.5% aluminum, about 3% vanadium, about 2% molybdenum, about 2% iron, and up to about 0.15% oxygen, and may have a constant thickness of about 2.9 mm. To form primary body 230, the striking face portion may be welded to the remaining portions, which may be integrally cast from, e.g., a Ti 6Al 4V alloy using thin wall casting techniques to yield a generally uniform thickness of about 1.2 mm throughout. In this embodiment, auxiliary body 232 may occupy about 198 $cm^2$ of the exterior surface area of the club head and have a mass of about 28.5 g. If made from the same Ti 6Al 4V alloy used in the primary body, the auxiliary body would have a mass of about 108 g. As shown in FIG. 25, a reinforced step lap joint configuration may be employed to join the auxiliary body 232 to primary body 230, additionally requiring about 10.5 g of titanium to form lap surface 238. Further, about 1.3 g of thermosetting epoxy resin and carbon fiber tape may be additionally provided as element 250 to reinforce the stepped lap joint. Thus, a net savings of about 68 g may be realized and added to the weight budget of head 200, thereby enabling further improvements to the finished club head's mass properties.

Figure 26:
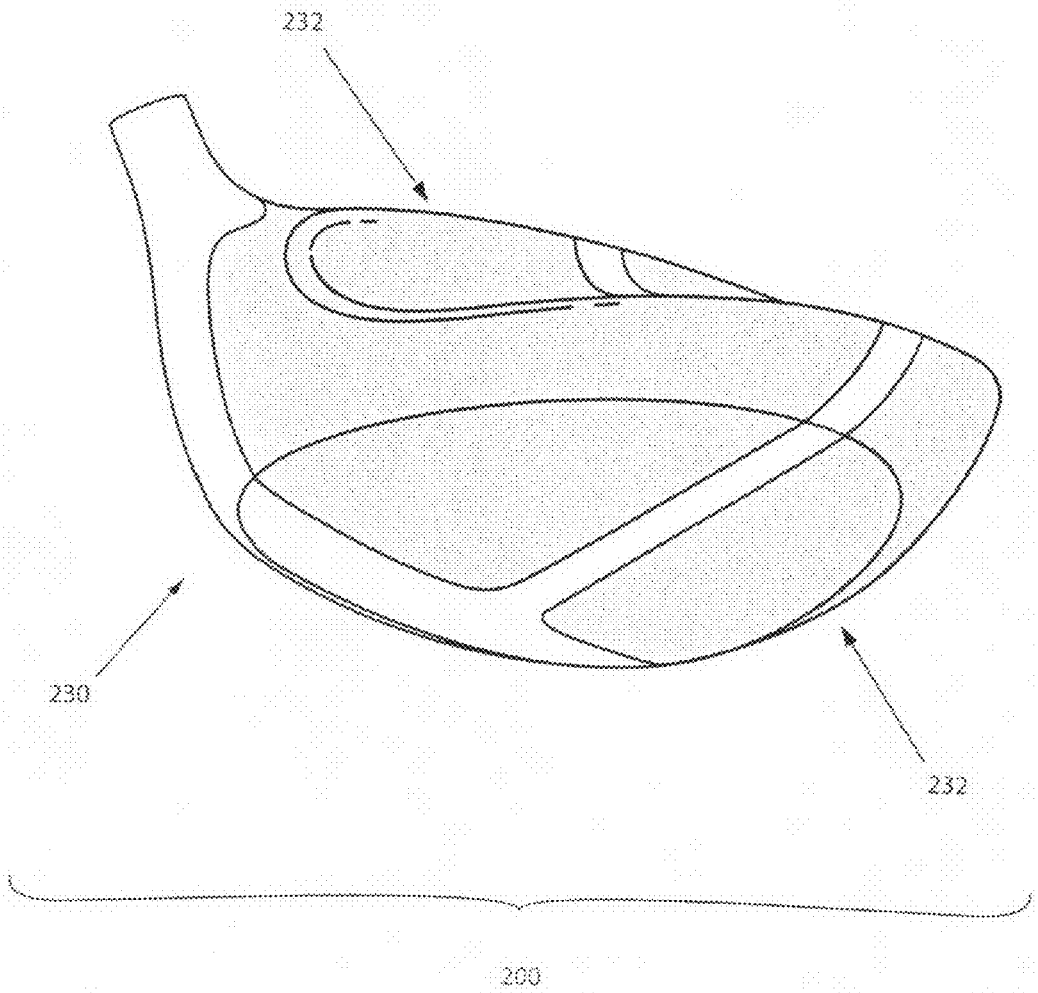
FIG. 26 is a perspective view of one more further embodiment of a head like that shown in FIG. 1.

Given the three previous examples, it is evident that the greater the amount of surface area auxiliary body 232 occupies, the greater the benefit will be to the weight budget of head 200. In determining the surface area of auxiliary body 232, additional factors, including effects to the acoustical response of head 200, consumer acceptance/marketability, and cosmetic considerations should be taken into account. Therefore, any combination of club head 200's portions, except striking surface portion 202, may be included in the auxiliary body. Further, it may be considered advantageous to provide more than one auxiliary body, as shown, by way of example only, in FIG. 26. Further still, it should be apparent that the auxiliary body (or bodies) need not incorporate entire portions of head 200, but rather may incorporate any fraction of those portions. In accordance with the preceding, it should be apparent that there are many possible permutations for configuring head 200, each of which are not discussed in thorough detail within this application to avoid unnecessarily obscuring the invention, yet all of which may be manufactured according to the principles disclosed herein.

Figure 27:
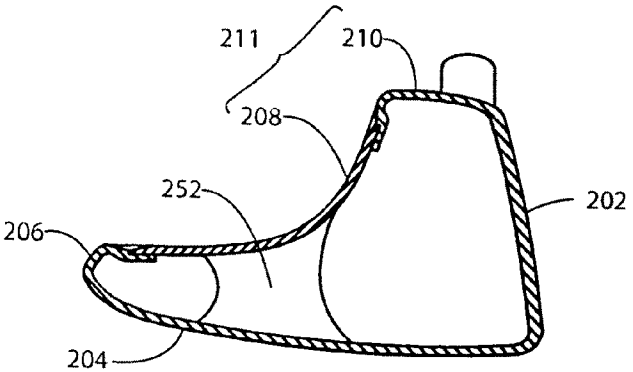
FIG. 27(*a*) is a cross-sectional view of an exemplary head in accordance with the present invention, showing internal features.
Figure 27:
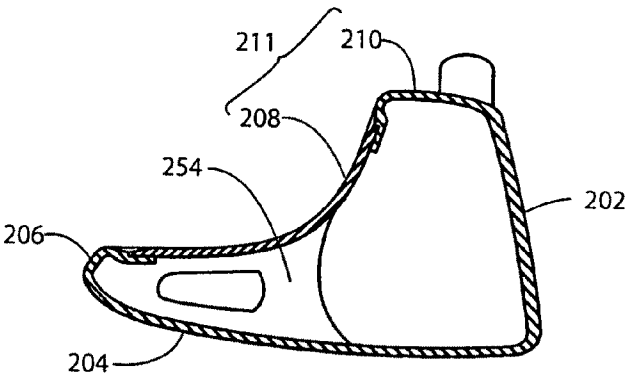
Figure 27:
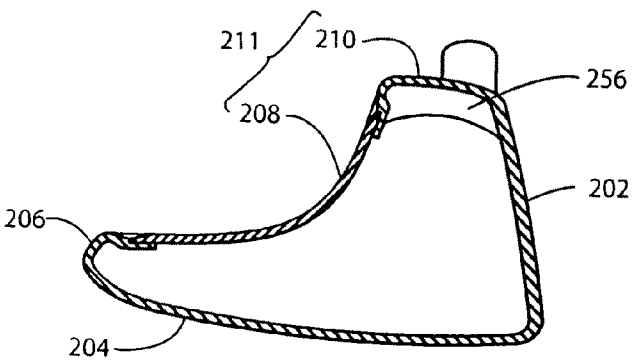
Figure 27:
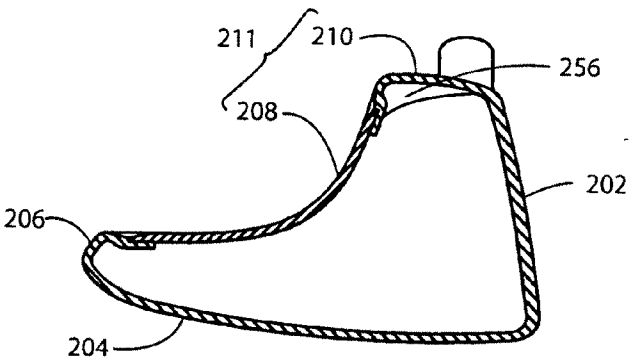

In addition to improving mass properties through the placement of mass within head 200, weight budget may also be expended to incorporate structural improvements which may have been heretofore impossible due to weight limitations. Such structures include stiffening means such as internal ribs, columns, or truss-like members, which locally stiffen head 200 at various locations to improve acoustical performance, and/or to improve the energy transfer efficiency from head 200 to a golf ball during use. In general, any combination of any of the club head's portions may be constrained to one another to assist in manipulating the frequency response of the head. It may be particularly advantageous to use one or more ribs, columns, or truss-like members to constrain crown 211 to sole portion 204. FIG. 27(*a*) shows, by way of example only, an exemplary rib 252 constraining the major crown portion 208 to the sole portion 204. Alternatively, crown 211, sole portion 204 and skirt portion 206 may all be constrained to one another with one or more ribs or truss-like members. FIG. 27(*b*) shows, by way of example only, an exemplary rib 254 constraining major crown portion 208 and skirt portion 206 to sole portion 204. Additionally, minor crown portion 210 may be constrained to major crown portion 208 and optionally to striking face portion 202. FIG. 27(*c*) shows, by way of example only, an exemplary rib 256 constraining minor crown portion 210 and major crown portion 208 to striking face 202. FIG. 27(*d*) shows, by way of example only, an exemplary rib 258 constraining major crown portion 208 to minor crown portion 210. It should be noted that any combination of the above examples may be produced in a single embodiment to achieve the qualities desired by the club head designer.

The above-mentioned stiffening means may also include locally improving one or more composite portions' material properties by tailoring the lay-up schedule to suit the structural requirements necessary to gain a certain desired performance advantage. This may require locally stiffening one or more of the portions in a certain direction or several directions, which may be accomplished by incorporating layers of prepreg sheet in addition to that which is required for the minimum strength as given in the preceding examples. The additional sheets may be locally oriented in any direction which will enhance the properties of the head in the manner desired. How the lay-up schedule is to be fine tuned may readily be determined by using finite element analysis methods to simulate impacts between head 200 and a golf ball and to identify problematic structural responses in the various portions of the club head, or localized areas that may benefit from further changes.

There may be particular benefits when the above techniques are adapted to produce a metal wood head that maintains the general proportions of a contemporary metal wood head having volumes from about 330 $cm^3$ to about 470 $cm^3$. Such heads are commonly referred to as drivers, and have loft angles ranging from about 5 to about 20 degrees. Face widths, $W_f$ (shown in FIG. 12), for such drivers typically range from about 8.89 to about 11.43 cm (3.5 to about 4.5 inches), and face heights range from about 4.57 to about 5.59 cm (1.8 to about 2.2 inches), yielding typical face surface areas of about 33.9 to about 51.6 $cm^2$ (5.25 to about 8.0 square inches). Overall maximum heel-to-toe dimensions, $W_h$, range from about 10.8 to about 12.7 cm (about 4.25 to about 5 inches), whereas maximum front-to-back dimensions, $L_h$ (as shown in FIG. 12), range from about 8.3 to about 10.8 cm (about 3.25 to about 4.25 inches). Club heads with displacements in these ranges typically have total surface areas ranging from about 258 to about 355 $cm^2$ (from about 40 to about 55 square inches), with crown surface areas accounting for about 77 to about 103 $cm^2$ (about 12 to about 16 square inches).

Club heads manufactured according to the techniques of this invention may retain all the dimensional characteristics given above, but with volumes in the range of 280 $cm^3$ to about 400 $cm^3$, and total surface areas in the range of about 226 to 335 $cm^2$ (about 35 to about 52 square inches). The crown area accounts for about 84 to about 116 $cm^2$ (about 13 to about 18 square inches), with the major crown portion generally contributing between 52 and 90 $cm^2$ (between 8 and 14 square inches).

The novel crown configuration disclosed for head 200 may be of particular benefit when applied to a metal wood golf club head having the following characteristics:

- a $W_h$ value greater than 11.18 cm (4.40")
- A major crown portion having a surface area of about 50 to about 80 $cm^2$
- A volume between 300 and 375 $cm^3$ in combination with a major crown portion surface area of about 50 to about 80 $cm^2$
- a $W_h$ value greater than 11.18 cm (4.40") in combination with an $L_r$ value between 1.27 to about 3.81 cm (about 0.5 to about 1.5 inches)
- a volume in the range of about 300 to about 375 $cm^3$ in combination with an $L_r$ value between about 1.27 to about 3.81 cm (about 0.5 to about 1.5 inches)
- an $L_h$ value greater than 3.40" in combination with an $L_r$ value between about 1.27 to about 3.81 cm (about 0.5 to about 1.5 inches)
- a volume in excess of 300 $cm^3$ in which the ratio of striking face portion surface area to head volume exceeds 0.105 $cm^{-1}$.
- a volume in excess of about 300 $cm^3$ in which the ratio of major crown portion surface area to head volume exceeds 0.140 $cm^{-1}$.
- a volume in excess of 300 $cm^3$ in which the ratio of $W_h$ to head volume exceeds 0.030 $cm^{-2}$.
- a volume in excess of 300 $cm^3$ in which the ratio of $L_h$ to volume exceeds 0.0095 $cm^{-2}$.
- a total volume to total surface area ratio having a value between about 1.05 and about 1.15.

The principles discussed herein enable about 10 to about 45 grams to be added to a metal wood's weight budget, and results in finished head center of gravity heights being lowered about 1 to about 10 mm. Furthermore, the moments of inertia of club head 200 are comparable to modern metal wood heads having correspondingly larger displacements. Therefore, club head 200 maintains the forgiveness of contemporary large displacement metal wood heads, but due to improved mass properties at the minimum structural mass coupled with an increased weight budget, may be configured to provide better launch characteristics. Alternatively, club head 200 may be produced with launch characteristics consistent with those of a modern metal wood club head, and excess discretionary weight may be utilized to increase moments of inertia and therefore the forgiveness of club head 200.

Accordingly, the metal wood head configurations disclosed herein demonstrate improved ball launching characteristics at impact resulting in increased carry. This is accomplished primarily by the lowering of the major crown portion, which yields improved mass characteristics at a metal wood club head's minimum structural mass in comparison to conventionally configured club heads having similar proportions. Further, this configuration makes more mass available for strategic placement within the club head, thereby affording the club head designer greater freedom to manipulate a head's mass properties, i.e. center of gravity location, and inertial moments about certain axes, parameters which define a club head's performance potential and forgiveness, respectively.

The above-described embodiments of the club head are given only as examples. Therefore, the scope of the invention should be determined not by the illustrations given, but by the appended claims and their equivalents.

What is claimed is:

1. A golf club head comprising:

a first portion comprising a striking face portion, the striking face portion comprising:

a front striking surface; and a return portion extending rearwardly about 1 cm to about 4 cm from the front striking surface, the return portion comprising a step portion including a first lap surface having a width between about 5 mm and about 20 mm, wherein a majority of the first portion is a metallic alloy;

a non-metallic second portion comprising:

a compression-molded carbon-fiber-reinforced plastic;

a wall thickness between about 0.6 mm and about 2 mm;

an abutment surface; and a second lap surface substantially perpendicular to the abutment surface and having a width between about 5 mm and about 20 mm;

a joint between the first lap surface of the first portion and the second lap surface of the second portion, wherein the first lap surface of the first portion is adhesively bonded to the second lap surface of the second portion; and a total surface area of the golf club head is between about 258 $cm^2$ and about 355 $cm^2$.

2. The golf club head of claim 1 further comprising a volume between about 330 $cm^3$ and about 470 $cm^3$.

3. The golf club head of claim 2, wherein the ratio of the total volume to the total surface area is between about 1.05 and about 1.15.

4. The golf club head of claim 1, wherein the striking face portion comprises a face width between about 88.9 mm and about 114.3 mm.

5. The golf club head of claim 1, wherein the striking face portion comprises a face height between about 45.7 mm and about 55.9 mm.

6. The golf club head of claim 1, wherein the joint between the first lap surface and the second lap surface extends along only a portion of the interface between the first portion and the second portion.

7. The golf club head of claim 1, wherein the joint between the first lap surface and the second lap surface is continuous along the entire interface between the first portion and the second portion.

8. The golf club head of claim 1, wherein the joint is a reinforced lap joint.

9. The golf club head of claim 1, wherein the joint is a scarf joint.

10. A golf club head comprising:

a first portion comprising a striking face portion, a sole portion, and a crown portion, the striking face portion comprising:

a front striking surface; and a return portion extending rearward about 1 cm to about 4 cm, from the front striking surface the return portion comprising a step portion including a first lap surface having a width between about 5 mm and about 20 mm, wherein a majority of the first portion is a metallic alloy;

a second portion comprising:

a specific strength of at least about 400 MPa/(g/$cm^3$);

a wall thickness between about 0.6 mm and about 2 mm;

a second lap surface having a width between about 5 mm and about 20 mm;

a joint between the first lap surface of the first portion and the second lap surface of the second portion, wherein the first lap surface of the first portion is adhesively bonded to the second lap surface of the second portion, the joint having a bondline thickness between about 0.127 mm and about 0.254 mm; and an internal rib coupled to the crown portion and the sole portion.

11. The golf club head of claim 10, wherein the second portion further comprises a non-metallic material.

12. The golf club head of claim 11, wherein the non-metallic material is a carbon-fiber-reinforced plastic.

13. The golf club head of claim 12, wherein the carbon-fiber-reinforced plastic is compression molded.

14. The golf club head of claim 12, wherein the specific strength is at least about 1000 Mpa/(g/$cm^3$).

15. The golf club head of claim 14, wherein the specific strength of the second portion is greater than the specific strength of the striking face portion.

16. The golf club head of claim 15, wherein the joint is a reinforced step lap joint.

17. The golf club head of claim 10, wherein the joint between the first lap surface and the second lap surface extends along only a portion of the interface between the first portion and the second portion.

18. The golf club head of claim 10, wherein the joint between the first lap surface and the second lap surface is continuous along the entire interface between the first portion and the second portion.

* * * * *